US008739813B2

(12) United States Patent
Moore et al.

(10) Patent No.: US 8,739,813 B2
(45) Date of Patent: Jun. 3, 2014

(54) WATERWAY FOR A SINGLE SUPPLY FAUCET

(75) Inventors: Jeffrey L. Moore, Frankfort, IN (US); Alfred C. Nelson, Westfield, IN (US)

(73) Assignees: Masco Corporation of Indiana, Indianapolis, IN (US); Mercury Plastics, Inc., Middlefield, OH (US)

( * ) Notice: Subject to any disclaimer, the term of this patent is extended or adjusted under 35 U.S.C. 154(b) by 392 days.

(21) Appl. No.: 13/091,865

(22) Filed: Apr. 21, 2011

(65) Prior Publication Data

US 2012/0018020 A1 Jan. 26, 2012

Related U.S. Application Data

(63) Continuation-in-part of application No. 12/854,541, filed on Aug. 11, 2010.

(60) Provisional application No. 61/366,410, filed on Jul. 21, 2010.

(51) Int. Cl.

| | |
|---|---|
| ***F16K 5/00*** | (2006.01) |
| ***F16K 5/10*** | (2006.01) |
| ***F16K 27/06*** | (2006.01) |
| ***E03C 1/04*** | (2006.01) |

(52) U.S. Cl.
USPC ..... 137/315.12; 137/625.41; 251/209; 4/677

(58) Field of Classification Search
USPC ..... 137/625.4, 625.41, 801, 315.12; 4/675–678, 695; 251/202, 205, 208, 251/209
See application file for complete search history.

(56) References Cited

U.S. PATENT DOCUMENTS

| | | | | |
|---|---|---|---|---|
| 4,043,359 | A | 8/1977 | Christo | |
| 5,558,128 | A | 9/1996 | Pawelzik et al. | |
| 6,058,972 | A * | 5/2000 | Kahle et al. | 137/625.4 |
| 6,154,897 | A | 12/2000 | Paini | |
| 6,185,760 | B1 | 2/2001 | Park | |
| 6,289,531 | B1 * | 9/2001 | Kahle et al. | 4/678 |
| 6,371,163 | B1 | 4/2002 | Kahle et al. | |
| 6,757,921 | B2 * | 7/2004 | Esche | 4/677 |
| 6,868,564 | B2 | 3/2005 | Ginter et al. | |
| 7,159,252 | B2 | 1/2007 | Underbrink et al. | |
| 7,182,100 | B2 | 2/2007 | Pinette | |
| 7,556,061 | B2 | 7/2009 | Morita et al. | |

(Continued)

FOREIGN PATENT DOCUMENTS

| | | | |
|---|---|---|---|
| WO | 2007139605 | A1 | 12/2007 |
| WO | 2010099397 | A1 | 9/2010 |

OTHER PUBLICATIONS

Moen Incorporated, Instruction pamphlet for One-Handle Kitchen Faucet, Models 7100 and 7106, INS1632A, 6 pages, May 2008.

(Continued)

*Primary Examiner* — John K Fristoe, Jr.
*Assistant Examiner* — Kevin Barss
(74) *Attorney, Agent, or Firm* — Faegre Baker Daniels LLP

(57) ABSTRACT

A fluid delivery device includes a waterway assembly, a valve assembly, and a waterway adapter to fluidly couple the waterway assembly to the valve assembly. The exemplary embodiment of the waterway assembly includes at least one inlet supply tube and at least one outlet supply tube generally disposed opposite to the at least one inlet supply tube. The waterway adapter and at least one inlet supply tube are supported by at least one coupler.

24 Claims, 28 Drawing Sheets

(56) References Cited

U.S. PATENT DOCUMENTS

| | | | | |
|---|---|---|---|---|
| 7,980,268 | B2 | 7/2011 | Rosko et al. | |
| 8,240,326 | B2 | 8/2012 | Kacik et al. | |
| 2003/0088913 | A1* | 5/2003 | Underbrink et al. | 4/619 |
| 2004/0010848 | A1 | 1/2004 | Esche | |
| 2004/0221385 | A1 | 11/2004 | Su | |
| 2006/0151034 | A1 | 7/2006 | Klein | |
| 2007/0271695 | A1* | 11/2007 | Thomas et al. | 4/675 |
| 2008/0276367 | A1 | 11/2008 | Bares et al. | |
| 2009/0020177 | A1 | 1/2009 | Nelson et al. | |
| 2009/0242058 | A1 | 10/2009 | Hansen | |
| 2010/0006166 | A1 | 1/2010 | Chen et al. | |
| 2010/0127202 | A1 | 5/2010 | Bors et al. | |
| 2010/0313979 | A1 | 12/2010 | Thomas et al. | |
| 2011/0016625 | A1 | 1/2011 | Marty et al. | |
| 2011/0297248 | A1 | 12/2011 | Nelson et al. | |
| 2012/0018009 | A1 | 1/2012 | Veros et al. | |
| 2012/0018020 | A1 | 1/2012 | Moore et al. | |

OTHER PUBLICATIONS

Moen Incorporated, Specifications for Single-Handle Single-Hole Mount High Arc Kitchen Faucet, Models 7100 and 7106, 2 pages, Aug. 2009.

Moen Incorporated, Illustrated Parts for Single-Handle Kitchen Faucet, Models 7100, 7100CSL, 7106, and 7106CSL, 3 pages, Mar. 2010.

Photos of Moen® One-Handle Kitchen Faucet Model 7100, (shown with faucet body disassembled), 6 pages, available on or before May 16, 2010.

International Searching Authority, International Search Report and Written Opinion for International Application No. PCT/US2011/044612, mailed Jan. 9, 2012, 9 pages.

* cited by examiner

WATERWAY FOR A SINGLE SUPPLY FAUCET

CROSS-REFERENCE TO RELATED APPLICATION

The present application is a continuation-in-part of U.S. patent application Ser. No. 12/854,541, filed Aug. 11, 2010, entitled "WATERWAY ADAPTER," which claims priority to U.S. Provisional Patent Application Ser. No. 61/366,410, filed Jul. 21, 2010, entitled "WATERWAY ADAPTER," the disclosures of which are expressly incorporated by reference herein.

BACKGROUND AND SUMMARY OF THE INVENTION

The present invention relates generally to plumbing fixtures and, more particularly, to a faucet including a waterway adapter.

Single supply faucets typically include a single inlet of water and a valve assembly that controls the flow of water to a delivery spout. The water inlet may be a cold water supply, a reverse osmosis supply, or filtered water supply, for example. At least one handle or knob may be provided to adjust the flow rate of water from the valve assembly to the delivery spout.

According to an illustrative embodiment of the present disclosure, a fluid delivery device is provided including a hub including a generally hollow body portion having a longitudinally disposed first open end and a valve portion having a laterally disposed second open end. The body portion of the hub is configured to rest atop a surface and the second open end of the valve portion is disposed substantially perpendicular to the first open end of the body portion. The fluid delivery device further includes a spout coupled to the hub and a valve assembly. The valve assembly is removably coupled to the valve portion of the hub and is in fluid communication with the spout. The fluid delivery device also includes a waterway assembly in fluid communication with the valve assembly. The waterway assembly includes a single inlet supply tube and a waterway adapter removably coupled to the body portion of the hub. The waterway adapter perpendicularly couples the single inlet supply tube to the valve assembly. The waterway assembly further includes a single outlet supply tube in fluid communication with the waterway adapter and the spout.

According to another illustrative embodiment of the present disclosure, a fluid delivery device is provided including a hub including a body portion disposed along a generally vertical axis and a valve portion disposed along a generally horizontal axis. The fluid delivery device further includes a valve assembly positionable in the valve portion of the hub along the generally horizontal axis. The fluid delivery device also includes a waterway adapter fluidly coupled to the valve assembly and positionable in the body portion of the hub along the generally vertical axis. The waterway adapter has a bottom end and a top end opposite the bottom end. The bottom end of the waterway adapter defines an inlet for receiving at least one inlet supply tube and the top end of the waterway adapter defines an outlet for receiving an outlet tube.

According to yet another illustrative embodiment of the present disclosure, a fluid delivery device is provided including a hub and a valve assembly removably coupled to the hub. The valve assembly includes an inlet port and an outlet port. The fluid delivery device further includes a waterway adapter coupled to the hub. The waterway adapter defines at least one inlet channel in fluid communication with at least one inlet supply tube. The waterway adapter further defines at least one outlet channel in fluid communication with at least one outlet supply tube. The at least one inlet channel of the waterway adapter is in fluid communication with the inlet port of the valve assembly. The at least one outlet channel of the waterway adapter is in fluid communication with the outlet port of the valve assembly. The fluid delivery device further includes at least one coupler removably coupled to the waterway adapter and the at least one inlet supply tube. The at least one coupler supports the at least one inlet supply tube within the waterway adapter in the hub and is positioned beneath the waterway adapter.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
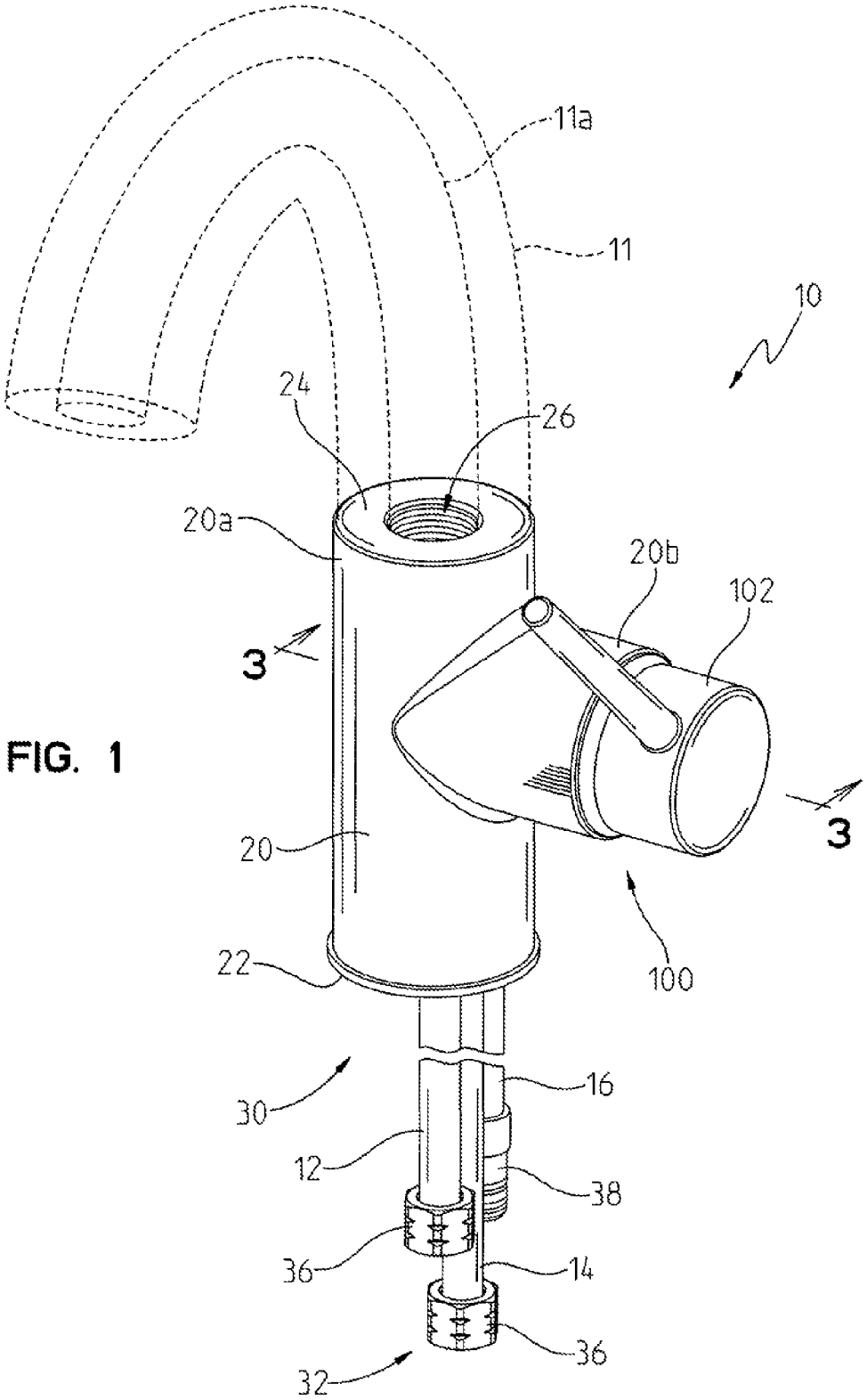
FIG. 1 is a perspective view of an illustrative embodiment faucet of the present disclosure.

The embodiments of the invention described herein are not intended to be exhaustive or to limit the invention to precise forms disclosed. Rather, the embodiments selected for description have been chosen to enable one skilled in the art to practice the invention. Although the disclosure is described in connection with water, it should be understood that additional types of fluids may be used.

Referring to FIGS. 1-4, an illustrative embodiment faucet 10 is shown including spout body 11 (shown in phantom), hub 20, waterway assembly 30, waterway adapter 60, and valve assembly 100. In operation, faucet 10 receives water from hot and cold water supplies (not shown) and mixes the incoming water to form an outlet stream. Faucet 10 may be mounted to a sink deck (not shown) or another suitable surface and may deliver the mixed outlet stream into a sink basin (not shown), for example.

Figure 2:
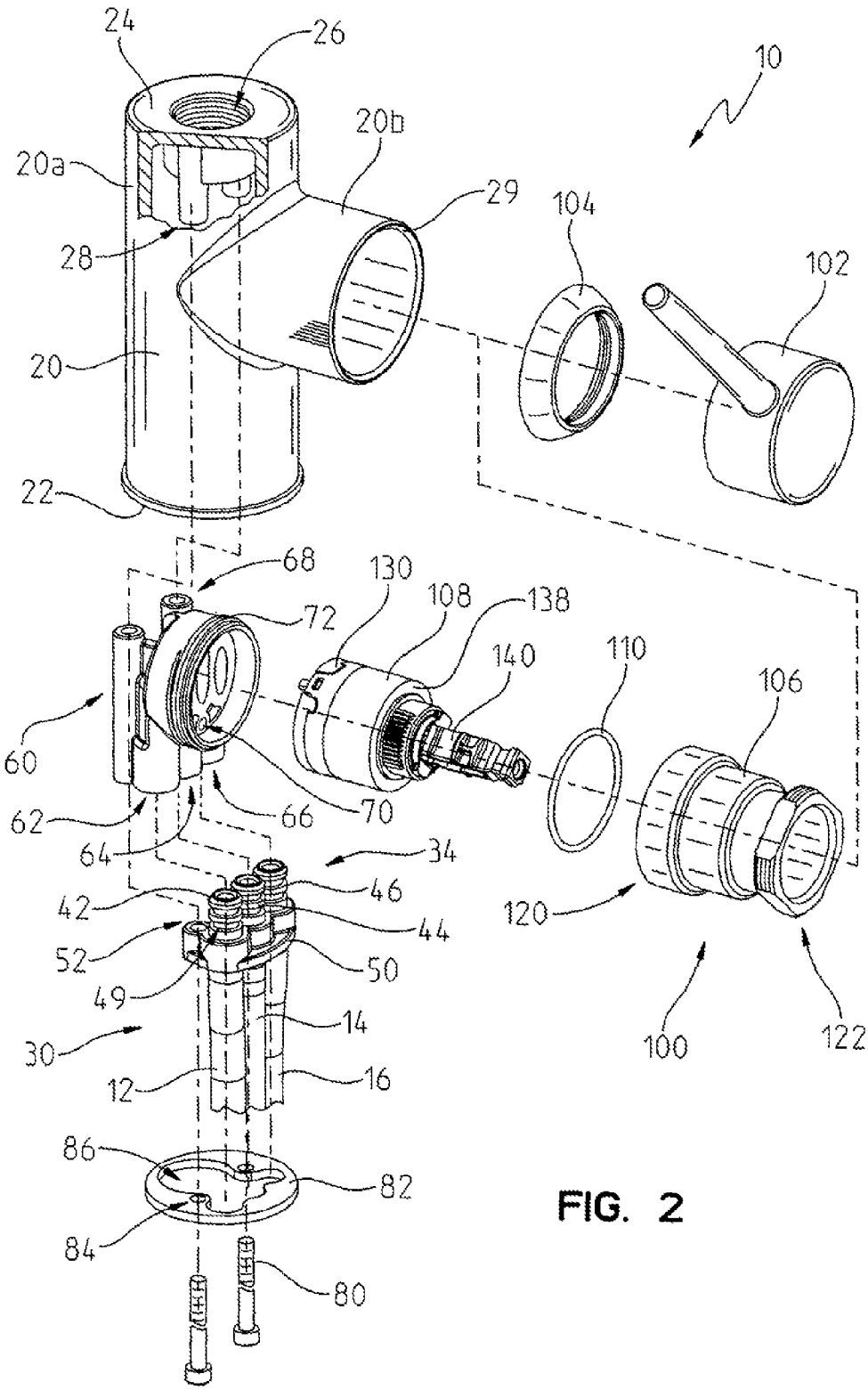
FIG. 2 is an exploded perspective view of the faucet of FIG. 1.

With reference to FIG. 2, the illustrative hub 20 of faucet 10 is a generally hollow component having a vertically disposed body portion 20*a* and a horizontally disposed valve portion 20*b* extending transversely therefrom. Body portion 20*a* of hub 20 includes an open bottom end 22 that is configured to rest against the sink deck (not shown) or other suitable surface. Body portion 20*a* of hub 20 also includes top end 24 that is configured to mate with spout body 11 (FIG. 1). As shown in FIG. 2, top end 24 of body portion 20*a* includes an internally threaded bore 26 that may be sized to receive and engage an externally threaded spout body 11, for example, thereby securing spout body 11 onto hub 20. Hub 20 may also define one or more internally threaded bores 28 for receiving screws 80 therein, as discussed further below. Like body portion 20*a* of hub 20, valve portion 20*b* of hub 20 also includes an open end 29. As shown in FIG. 2, open end 22 is longitudinally disposed and open end 29 is laterally disposed at a substantially 90 degree angle from open end 22.

Hub 20 of faucet may be formed of a traditional metallic material, such as zinc or brass. It is also within the scope of the present disclosure that hub 20 may be formed of a non-metallic material, such as a polymer, illustratively a cross-linkable polymer. Suitable non-metallic materials that may be used to construct hub 20 include cross-linkable polyethylene (PEX), polybutylene terephthalate (PBT), polyester, melamine, melamine urea, and melamine phenolic.

With continued reference to FIG. 2, the illustrative waterway assembly 30 of faucet 10 includes hot water inlet tube 12, cold water inlet tube 14, and outlet tube 16. Hot and cold water inlet tubes 12, 14, of waterway assembly 30 may be fluidly coupled to hot and cold water supplies (not shown), respectively, for receiving water into faucet 10. Outlet tube 16 of waterway assembly 30 may be fluidly coupled to a spout tube (not shown) for delivering water from faucet 10. Each tube 12, 14, 16, extends between first end 32 and an opposing second end 34.

As shown in FIG. 1, first end 32 of each tube 12, 14, 16, extends freely beneath hub 20. First ends 32 of hot and cold water inlet tubes 12, 14, may include conventional fluid couplings, such as nuts 36, for fluidly coupling hot and cold inlet tubes 12, 14, onto the hot and cold water supplies, respectively. First end 32 of outlet tube 16 may include tip 38 for fluidly coupling outlet tube 16 into spout tube 11*a* that extends upwardly through spout body 11 to dispense water from faucet 10.

Figure 3:
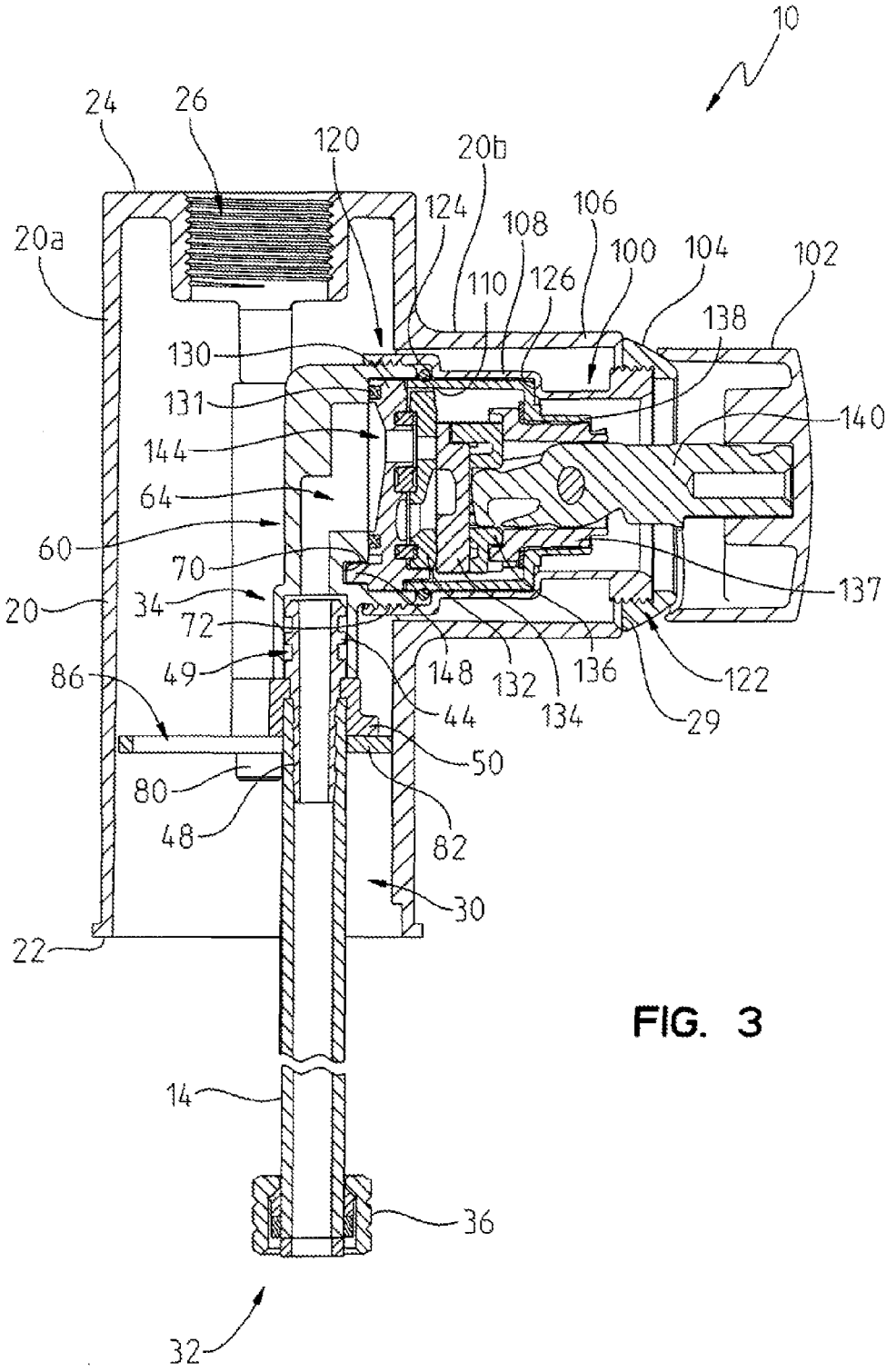
FIG. 3 is a cross-sectional view of the faucet of FIG. 1, taken along line 3-3 of FIG. 1.

As shown in FIG. 2, second end 34 of each tube 12, 14, 16, is received within hub 20. Second end 34 of each tube 12, 14, 16, may receive a corresponding connector, illustratively nipple 42, 44, 46, therein. Each nipple 42, 44, 46, may include external projections or barbs 48, as shown in FIG. 3, for gripping the corresponding tube 12, 14, 16. Also, each nipple 42, 44, 46, may define one or more external, annular grooves 49 for receiving sealing rings (not shown) therein.

The illustrative waterway assembly 30 of faucet 10 also includes a disk-shaped body or collar 50 that surrounds and supports tubes 12, 14, 16, specifically second ends 34 of tubes 12, 14, 16, as shown in FIG. 2. In this arrangement, first ends 32 of tubes 12, 14, 16, hang freely beneath collar 50 and nipples 42, 44, 46, extend above collar 50. Collar 50 may define one or more apertures 52 for receiving screws 80 therethrough, as discussed further below.

To limit contact between the water in faucet 10 and metallic components, waterway assembly 30 may be formed of a flexible, non-metallic material, such as a polymer, illustratively a cross-linkable polymer. As such, waterway assembly 30 is illustratively electrically non-conductive. In one illustrative embodiment, substantially the entire waterway assembly 30 (including tubes 12, 14, 16, nipples 42, 44, 46, and collar 50) is formed of a polyethylene which is subsequently cross-linked to form cross-linked polyethylene (PEX). Other suitable materials that may be used to construct waterway assembly 30 include polyethylene (PE) (such as raised temperature resistant polyethylene (PE-RT)), polypropylene (PP) (such as polypropylene random (PPR)), and polybutylene (PB). It is further envisioned that waterway assembly 30 may be constructed of cross-linked polyvinyl chloride (PVCX) using silane free radical initiators, cross-linked polyurethane, or cross-linked propylene (XLPP) using peroxide or silane free radical initiators. It is within the scope of the present disclosure that the polymer material used to construct waterway assembly 30 may include reinforcing members, such as glass fibers.

Waterway assembly 30 may be constructed by the method set forth in International Patent Application No. PCT/US10/25524 to Nelson et al., filed Feb. 26, 2010, entitled "FAUCET MANIFOLD," the disclosure of which is expressly incorporated by reference herein. In a first step of the illustrative method, nipples 42, 44, 46, are inserted into the corresponding tubes 12, 14, 16, with barbs 48 engaging tubes 12, 14, 16, to resist withdrawal of nipples 42, 44, 46, from the corresponding tubes 12, 14, 16. In a second step of the illustrative method, collar 50 is formed by overmolding collar 50 around second ends 34 of tubes 12, 14, 16, and nipples 42, 44, 46, located therein. This overmolding step forms a material-to-material bond between collar 50 and tubes 12, 14, 16. In a third step of the illustrative method, the assembled waterway assembly 30 is optionally cross-linked.

With reference to FIGS. 2 and 3, the illustrative waterway adapter 60 of faucet 10 fluidly couples waterway assembly 30 to valve assembly 100. Waterway adapter 60 defines hot water inlet channel 62, cold water inlet channel 64, and outlet channel 66. In the illustrated embodiment, channels 62, 64, 66, are bent or L-shaped to couple the vertically disposed waterway assembly 30 to the horizontally disposed valve assembly 100. As shown in FIG. 3, each channel 62, 64, 66, of waterway adapter 60 is sized to receive a corresponding nipple 42, 44, 46, of waterway assembly 30. Providing seals (not shown) in grooves 49 of nipples 42, 44, 46, as discussed above, may resist leakage between waterway assembly 30 and waterway adapter 60.

To further limit contact between the water in faucet 10 and metallic components, waterway adapter 60 may be formed of a non-metallic material, such as a polymer. In one illustrative embodiment, waterway adapter 60 is formed of a glass fiber reinforced polysulfone, such as Udel® GF-110, which is a registered trademark of Solvay Advanced Polymers of Alpharetta, Ga. In another illustrative embodiment, waterway adapter 60 is formed of polyethylene, which may be subsequently cross-linked to form cross-linked polyethylene (PEX). Other suitable materials that may be used to construct waterway adapter 60 include polyethylene (PE) (such as raised temperature resistant polyethylene (PE-RT)), polypropylene (PP) (such as polypropylene random (PPR)), and polybutylene (PB). It is further envisioned that waterway adapter 60 may be constructed of cross-linked polyvinyl chloride (PVCX) using silane free radical initiators, cross-linked polyurethane, or cross-linked propylene (XLPP) using peroxide or silane free radical initiators. It is within the scope of the present disclosure that the polymer material used to construct waterway adapter 60 may include reinforcing members, such as glass fibers.

As discussed further below, waterway adapter 60 defines apertures 68 that receive screws 80 therethrough for coupling waterway adapter 60 to waterway assembly 30 and to hub 20. Also, waterway adapter 60 includes pin holes 70 and externally threaded rim 72 for coupling waterway adapter 60 to valve assembly 100.

As shown in FIG. 2, one or more fasteners, such as screws 80, and mounting plate 82 are provided to secure waterway assembly 30 and waterway adapter 60 within hub 20. Like waterway adapter 60 and collar 50 of waterway assembly 30, mounting plate 82 defines corresponding apertures 84 for receiving screws 80 therethrough. Faucet 10 may be assembled by inserting waterway adapter 60 and waterway assembly 30 upwardly into body portion 20*a* of hub 20 through the open first end 22 of hub 20. As shown in FIG. 3, waterway adapter 60 and waterway assembly 30 are both narrower than the open first end 22 of hub 20 so that both components may be inserted upwardly into body portion 20*a* of hub 20 through the open first end 22 of hub 20. When assembled, screws 80 extend through apertures 84 in mounting plate 82, through apertures 52 in collar 50, through apertures 68 in waterway adapter 60, and into internally threaded bores 28 of hub 20, thereby securing waterway assembly 30 and waterway adapter 60 into body portion 20*a* of hub 20.

Mounting plate 82 also defines central aperture 86 that is sized to accommodate spout tube 11*a* (FIG. 1) that extends upwardly from tip 38 of outlet tube 16, through body portion 20*a* of hub 20, and into spout body 11 (FIG. 1) mounted atop hub 20 to dispense water from faucet 10. When assembled, spout tube 11*a* may extend upwardly through central aperture 86 of mounting plate 82, alongside collar 50 of waterway assembly 30, and alongside waterway adapter 60 until reaching spout body 11 mounted atop hub 20. As shown in FIG. 2, mounting plate 82 entirely encloses central aperture 86. However, mounting plate 82 may also be slitted like mounting plate 82' of FIG. 6 to facilitate assembly of mounting plate 82' onto waterway assembly 30', as discussed further below.

Referring to FIGS. 2 and 3, the illustrative valve assembly 100 of faucet 10 includes handle 102, bonnet 104, sleeve 106, valve body 108, and seal 110. As shown in FIG. 3, valve assembly 100 is supported by valve portion 20*b* of hub 20 and is removably coupled to waterway adapter 60 located in body portion 20*a* of hub 20. In this illustrative embodiment, valve assembly 100 may be removed from the open end 29 of valve portion 20*b* of hub 20 for cleaning or servicing without having to remove waterway adapter 60 from body portion 20*a* of hub 20.

Sleeve 106 of the illustrative valve assembly 100 includes an internally threaded first end 120 and an externally threaded second end 122. Sleeve 106 also includes first internal shoulder 124 and second internal shoulder 126. In the illustrated embodiment of FIG. 3, valve body 108 is removably coupled to waterway adapter 60 by fitting sleeve 106 over valve body 108 and screwing the internally threaded first end 120 of sleeve 106 onto the externally threaded rim 72 of waterway adapter 60. As shown in FIG. 3, second shoulder 126 of sleeve 106 forces valve body 108 against waterway adapter 60, with first shoulder 124 of sleeve 106 engaging seal 110 to reduce leakage between waterway adapter 60 and sleeve 106. Bonnet 104 may then be screwed onto the externally threaded second end 122 of sleeve 106 for receiving handle 102 thereon.

Figure 4:
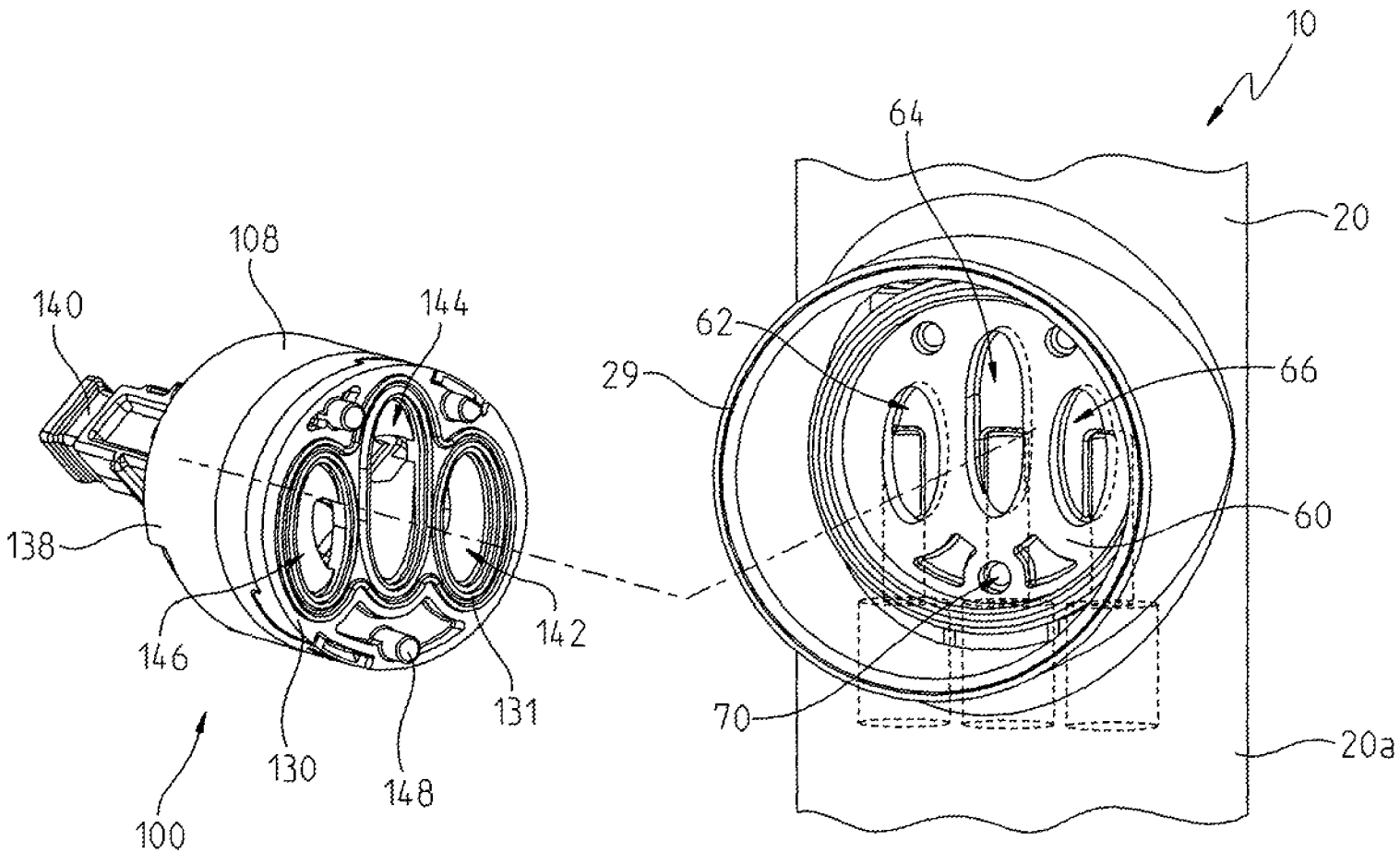
FIG. 4 is an exploded perspective view of a hub and a valve body of the faucet of FIG. 1.
Figure 5:
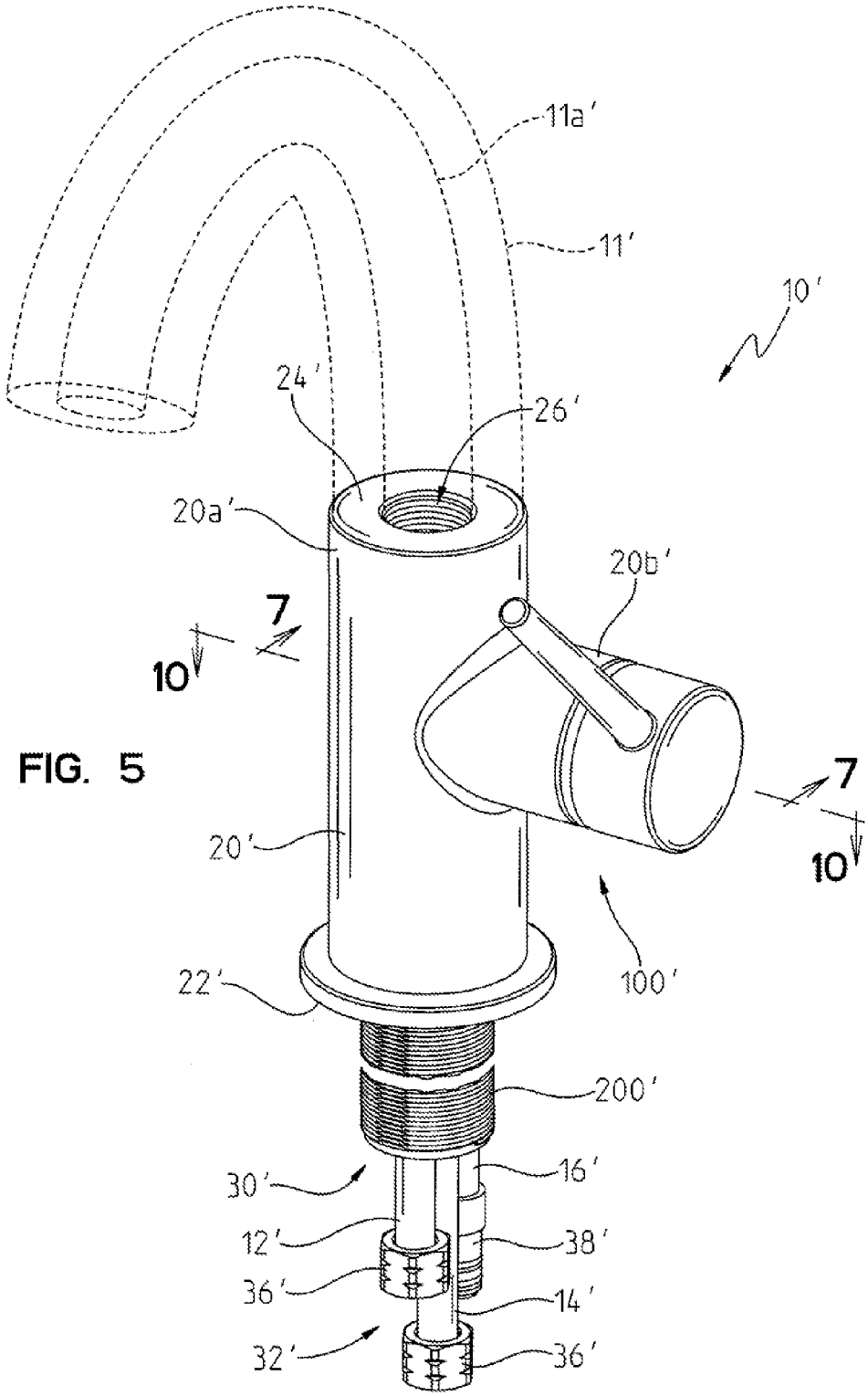
FIG. 5 is a perspective view of another illustrative embodiment faucet of the present disclosure.

Valve body 108 of the illustrative valve assembly 100 includes lower housing 130 having face seal 131 thereon, lower disc 132, upper disc 134, carrier 136, coupling member 137, upper housing 138, and stem 140. Illustratively, both upper disc 134 and lower disc 132 are constructed of a ceramic material or another suitable material, such as stainless steel. As shown in FIG. 4, valve body 108 also includes hot water inlet port 142, cold water inlet port 144, and outlet port 146. When assembled, hot water inlet port 142 of valve body 108 is arranged in fluid communication with hot water inlet channel 62 of waterway adapter 60, cold water inlet port 144 of valve body 108 is arranged in fluid communication with cold water inlet channel 64 of waterway adapter 60, and outlet port 146 of valve body 108 is arranged in fluid communication with outlet channel 66 of waterway adapter 60. Face seal 131 on lower housing 130 of valve body 108 may seal against waterway adapter 60, as shown in FIG. 3, to resist leakage between the components.

One or more first locating elements, illustratively pegs 148 of FIG. 4, extend from valve body 108 to assist with coupling valve body 108 to waterway adapter 60. As shown in FIG. 4, pegs 148 extend from lower housing 130 of valve body 108 and into corresponding pin holes 70 of waterway adapter 60. Positioning each peg 148 of valve body 108 within a corresponding pin hole 70 of waterway adapter 60 may facilitate proper orientation of valve body 108 relative to waterway adapter 60, and as a result, proper orientation of valve body 108 relative to waterway assembly 30. Thus, positioning each peg 148 of valve body 108 within a corresponding pin hole 70 of waterway adapter 60 may facilitate proper orientation of tubes 12, 14, 16, and nipples 42, 44, 46, of waterway assembly 30, channels 62, 64, 66, of waterway adapter 60, and ports 142, 144, 146, of valve body 108, respectively. Also, positioning each peg 148 of valve body 108 within a corresponding pin hole 70 of waterway adapter 60 may improve resistance to torque generated between hub 20, waterway assembly 30, waterway adapter 60, and valve assembly 100.

The illustrative valve assembly 100 may be operated by adjusting handle 102. Adjusting handle 102 actuates stem 140 of valve body 108, which transmits movement of handle 102 to upper disc 134 via carrier 136. As shown in FIG. 3, upper disc 134 is positioned adjacent to lower disc 132 to control the mixing of hot and cold water and the flow rate of water through valve body 108. Therefore, by adjusting handle 102 and moving upper disc 134 relative to lower disc 132, a user is able to selectively vary the temperature and flow rate of water supplied to outlet port 146 of valve body 108 via hot and cold water inlet ports 142, 144, of valve body 108. Because waterway assembly 30 is in fluid communication with valve body 108 via waterway adapter 60, adjusting handle 102 allows a user to selectively vary the temperature and flow rate of water supplied to outlet tube 16 of waterway assembly 30 from hot and cold water inlet tubes 12, 14, of waterway assembly 30. While the illustrative valve assembly 100 is of a movable disc variety, it should be appreciated that other types of valve assemblies may be substituted therefor. For example, a ball-type mixing valve assembly may find equal applicability with the present invention.

In use, hot and cold water flows from hot and cold water supplies (not shown) to valve assembly 100 of faucet 10. More particularly, hot water flows from the hot water supply to hot water inlet port 142 of valve assembly 100 via hot water inlet tube 12 of waterway assembly 30, hot water inlet nipple 42 of waterway assembly 30, and hot water inlet channel 62 of waterway adapter 60. Similarly, cold water flows from the cold water supply to cold water inlet port 144 of valve assembly 100 via cold water inlet tube 14 of waterway assembly 30, cold water inlet nipple 44 of waterway assembly 30, and cold water inlet channel 64 of waterway adapter 60. Then, the hot and cold inlet water streams are mixed and redirected in valve assembly 100. The mixed outlet water stream flows from outlet port 146 of valve assembly 100, through outlet channel 66 of waterway adapter 60, through outlet nipple 46 of waterway assembly 30, and through outlet tube 16 of waterway assembly 30.

Referring next to FIGS. 5-11, another illustrative embodiment faucet 10' is shown including spout body 11' (shown in phantom), hub 20', waterway assembly 30', waterway adapter 60', and valve assembly 100'. Faucet 10' of FIGS. 5-11 includes features similar to those of faucet 10 of FIGS. 1-4, with like reference numerals indicating like elements, except as described below.

Figure 6:
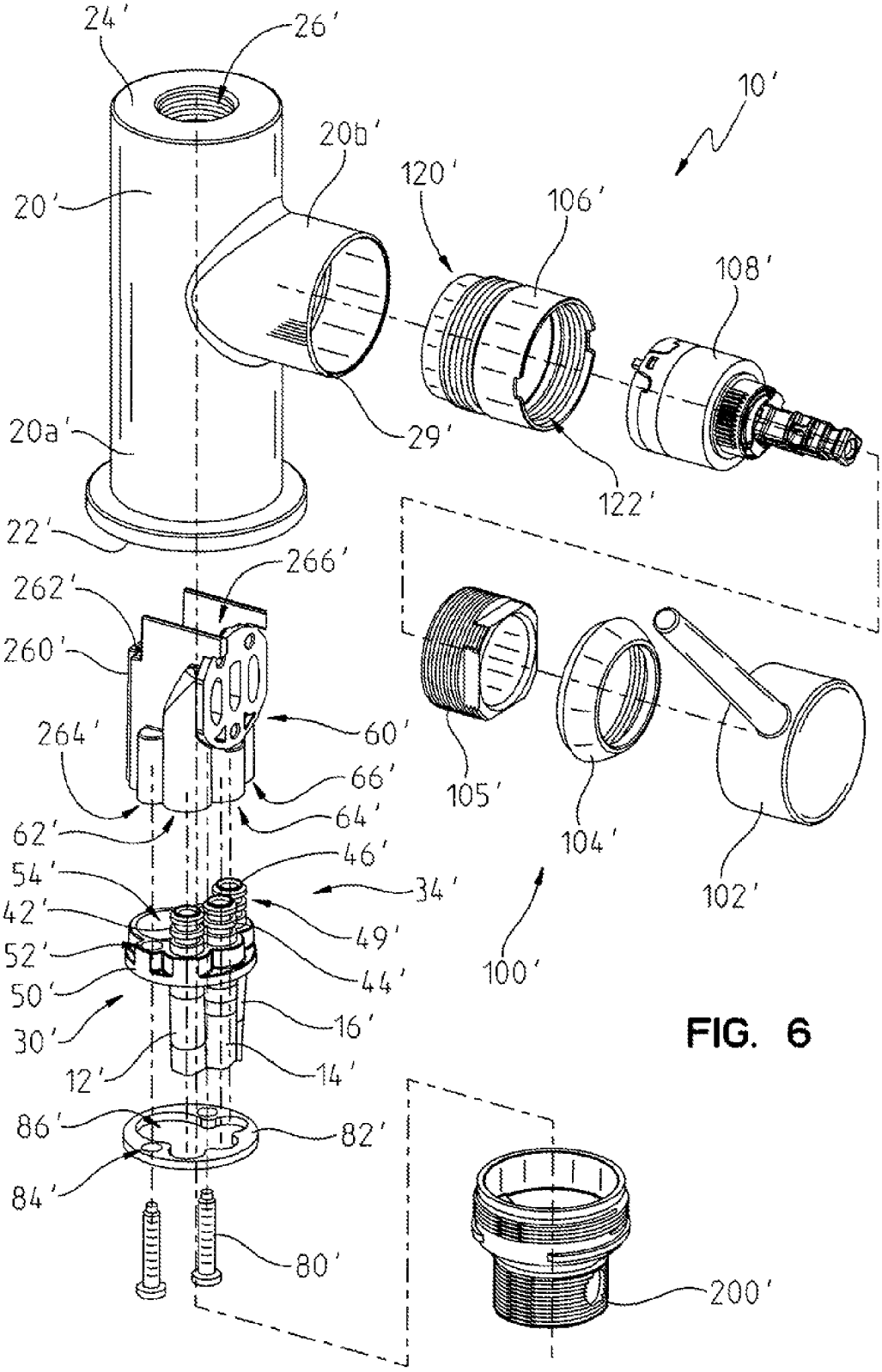
FIG. 6 is an exploded perspective view of the faucet of FIG. 5.
Figure 7:
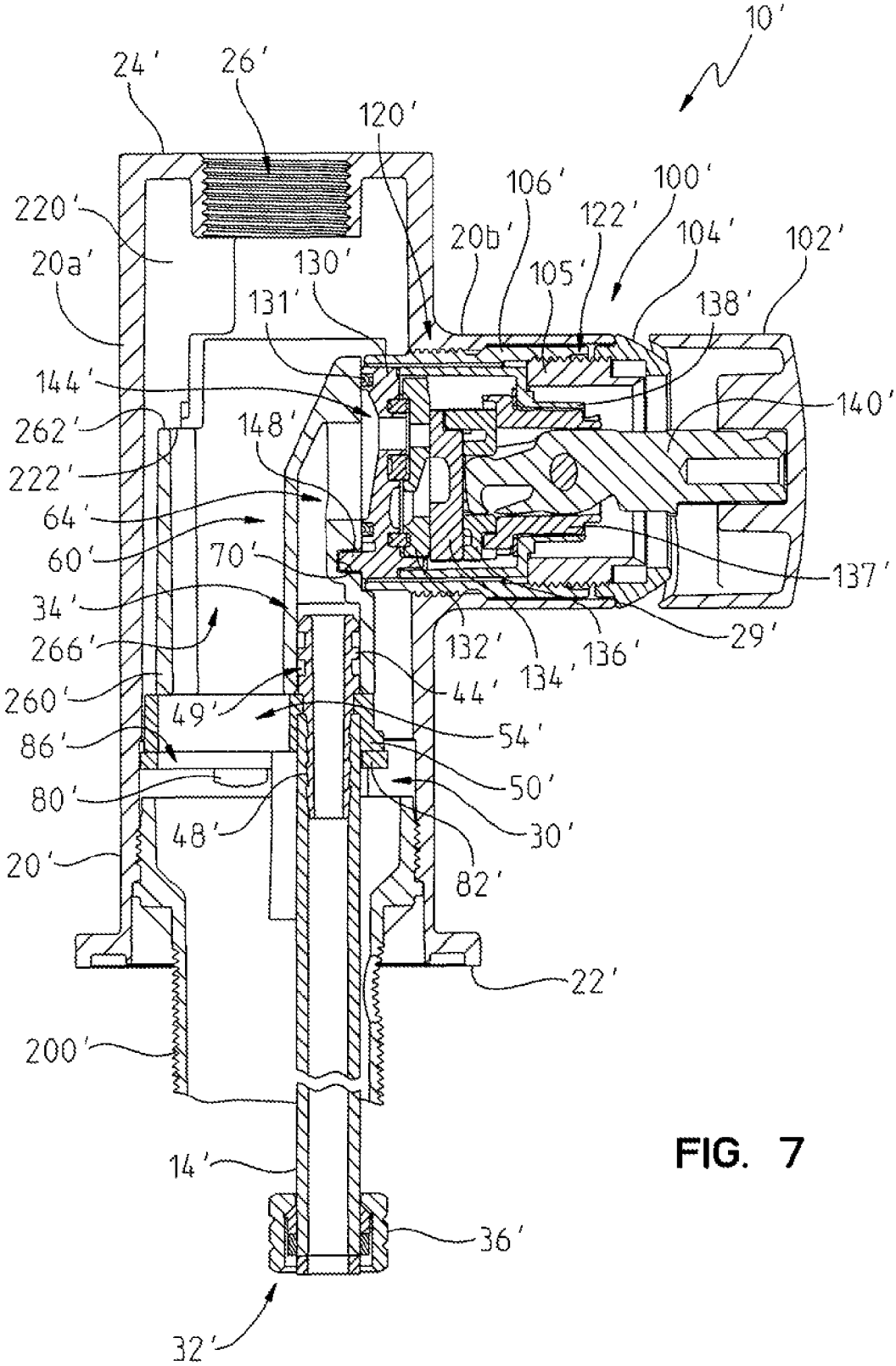
FIG. 7 is a cross-sectional view of the faucet of FIG. 5, taken along line 7-7 of FIG. 5.

With reference to FIGS. 6 and 7, the illustrative hub 20' of faucet 10' includes a vertically disposed body portion 20*a*' and a horizontally disposed valve portion 20*b*' extending transversely therefrom. Body portion 20*a*' of the illustrative hub 20' has an internally threaded and open bottom end 22' that is configured to engage an externally threaded mounting shank 200'. With bottom end 22' of hub 20' resting atop the sink deck (not shown), mounting shank 200' extends beneath the sink deck and may receive a bracket (not shown) for securing faucet 10' onto the sink deck. As shown in FIG. 7, valve portion 20*b*' of the illustrative hub 20' may be internally threaded, as discussed further below. Like body portion 20*a*' of hub 20', valve portion 20*b*' of hub 20' also includes an open end 29'. As shown in FIG. 7, open end 22' is longitudinally disposed and open end 29' is laterally disposed at a substantially 90 degree angle from open end 22'.

With continued reference to FIG. 6, the illustrative waterway assembly 30' of faucet 10' includes a disk-shaped body or collar 50' that surrounds and supports tubes 12', 14', 16'. Collar 50' may define one or more apertures 52' for receiving screws 80' therethrough. Additionally, collar 50' may define a central aperture 54' that is sized to accommodate spout tube 11*a*' (FIG. 5), as discussed further below.

Figure 8:
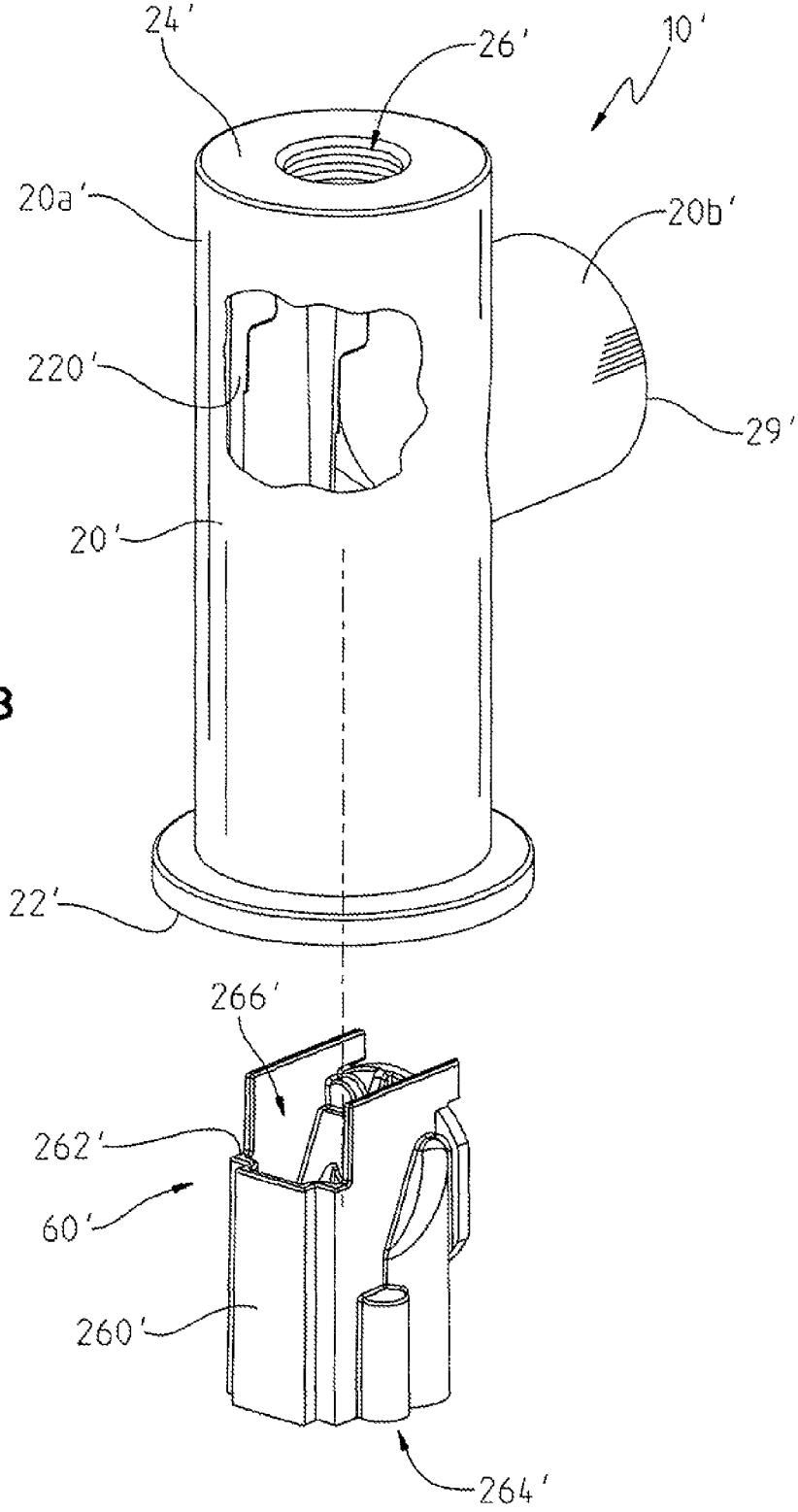
FIG. 8 is an exploded perspective view of a hub and a waterway adapter of the faucet of FIG. 5.
Figure 9:
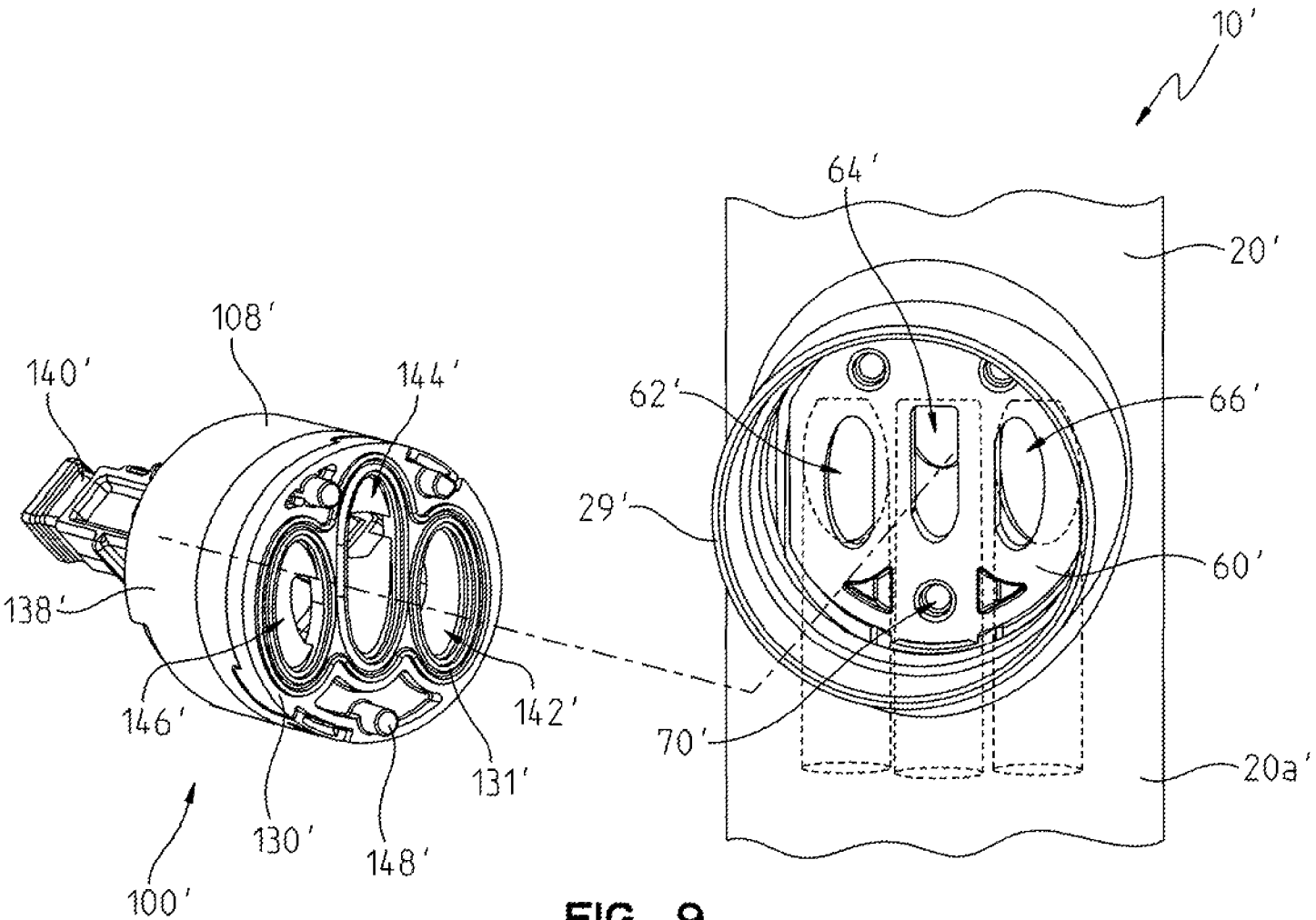
FIG. 9 is an exploded perspective view of the hub and a valve body of the faucet of FIG. 5.

With reference to FIGS. 7 and 8, the illustrative waterway adapter 60' of faucet 10' includes rear protrusion 260' having an upper shoulder 262'. Waterway adapter 60' may also include internally threaded bores 264', as discussed further below. As shown in FIG. 7, waterway adapter 60' is a generally hollow component that defines opening 266' therethrough. Opening 266' extends vertically through waterway adapter 60' and is bordered on one side by channels 62', 64', 66', and on the opposite side by rear protrusion 260'.

As shown in FIG. 6, one or more fasteners, such as screws 80', and mounting plate 82' are provided to secure waterway assembly 30' to waterway adapter 60'. Like collar 50' of waterway assembly 30', mounting plate 82' defines corresponding apertures 84' for receiving screws 80' therethrough. When assembled, screws 80' extend through apertures 84' in mounting plate 82', through apertures 52' in collar 50', and into internally threaded bores 264' of waterway adapter 60', thereby securing waterway assembly 30' to waterway adapter 60'.

Mounting plate 82' also defines central aperture 86' that is sized to accommodate a spout tube 11*a*' (FIG. 5) that extends upwardly from tip 38' of outlet tube 16', through body portion 20*a*' of hub 20', and into spout body 11' (FIG. 5) mounted atop hub 20' to dispense water from faucet 10'. When assembled, spout tube 11*a*' may extend upwardly through central aperture 86' of mounting plate 82', through central aperture 54' of collar 50', and through opening 266' in waterway adapter 60' until reaching spout body 11' mounted atop hub 20'.

As shown in FIG. 6, mounting plate 82' may be slit along central aperture 86' to facilitate assembly of mounting plate 82' onto waterway assembly 30'. In this embodiment, tubes 12', 14', 16', of waterway assembly 30' may be snapped into the slitted mounting plate 82'. Alternatively, it is also within the scope of the present disclosure that mounting plate 82' may entirely enclose central aperture 86', like mounting plate 82 of FIG. 2.

Referring to FIGS. 6 and 7, the illustrative valve assembly 100' of faucet 10' includes handle 102', bonnet 104', nut 105', sleeve 106', and valve body 108'. Sleeve 106' of the illustrative valve assembly 100' includes an externally threaded first end 120' and an internally threaded second end 122'. Nut 105' of the illustrative valve assembly 100' is externally threaded and configured to fit within the internally threaded second end 122' of sleeve 106'.

Figure 10:
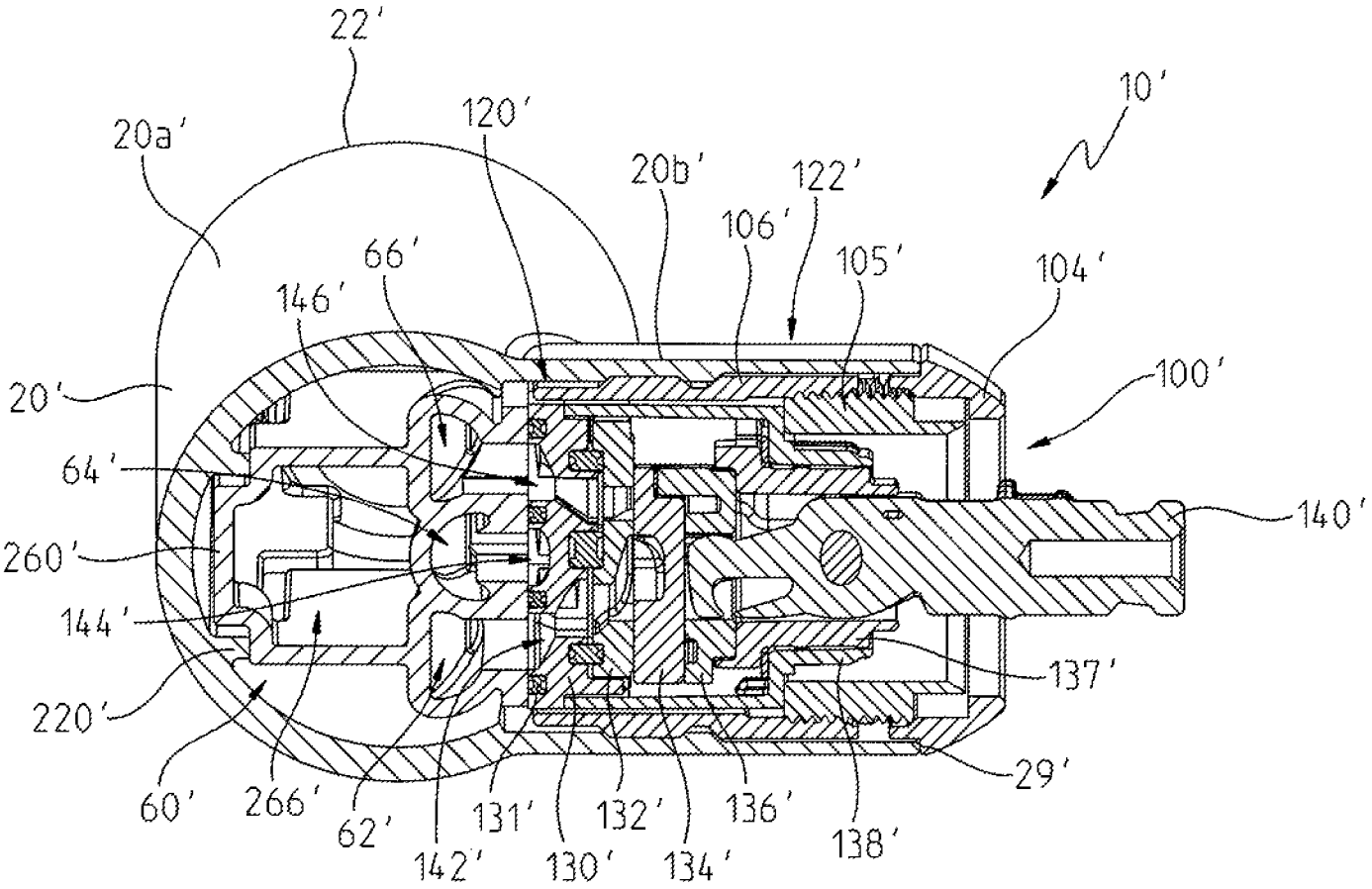
FIG. 10 is a cross-sectional view of the faucet of FIG. 5, taken along line 10-10 of FIG. 5, shown with the waterway adapter inside the hub.
Figure 11:
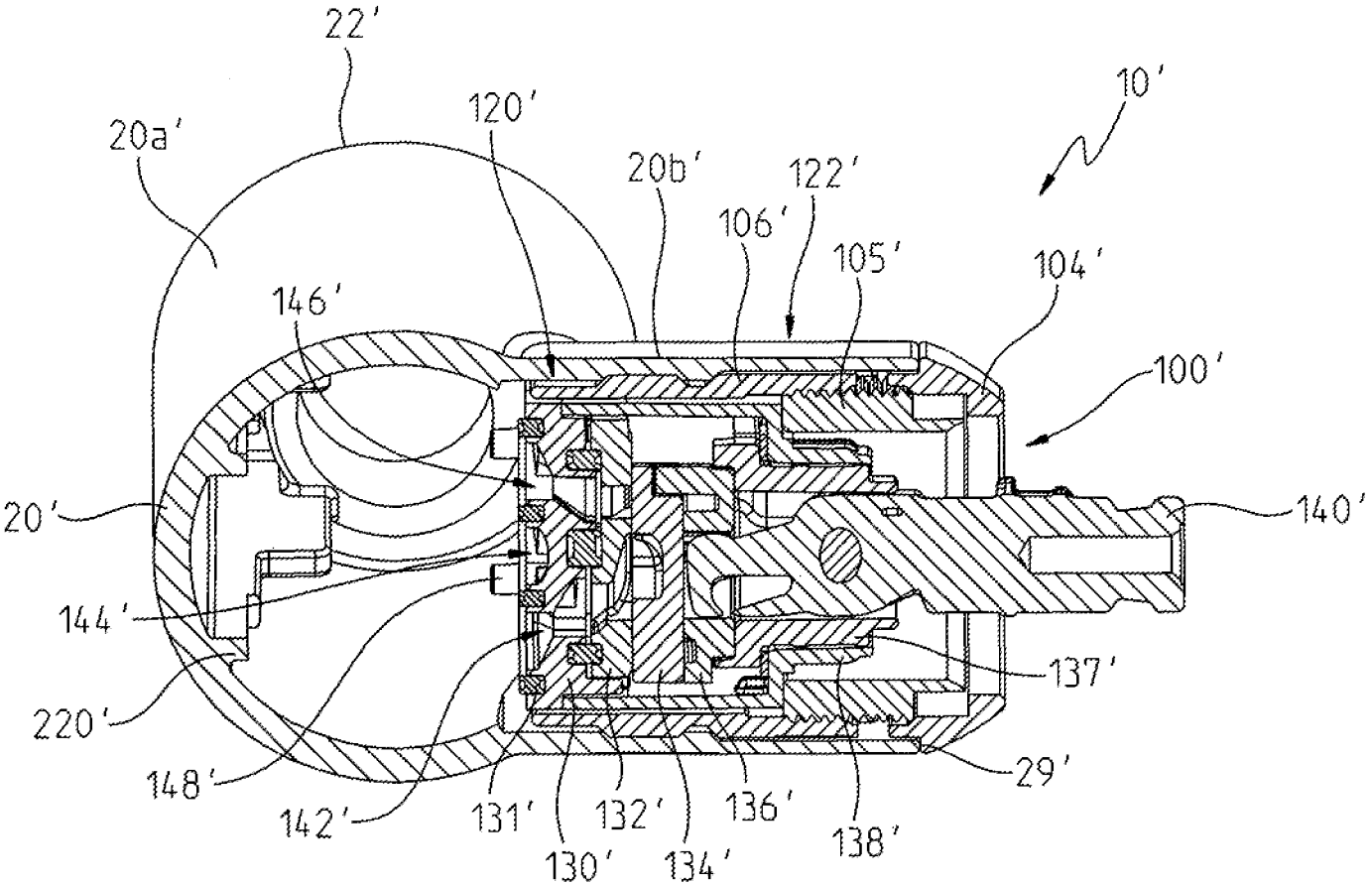
FIG. 11 is a cross-sectional view similar to FIG. 10, shown with the waterway adapter removed from the hub.
Figure 12:
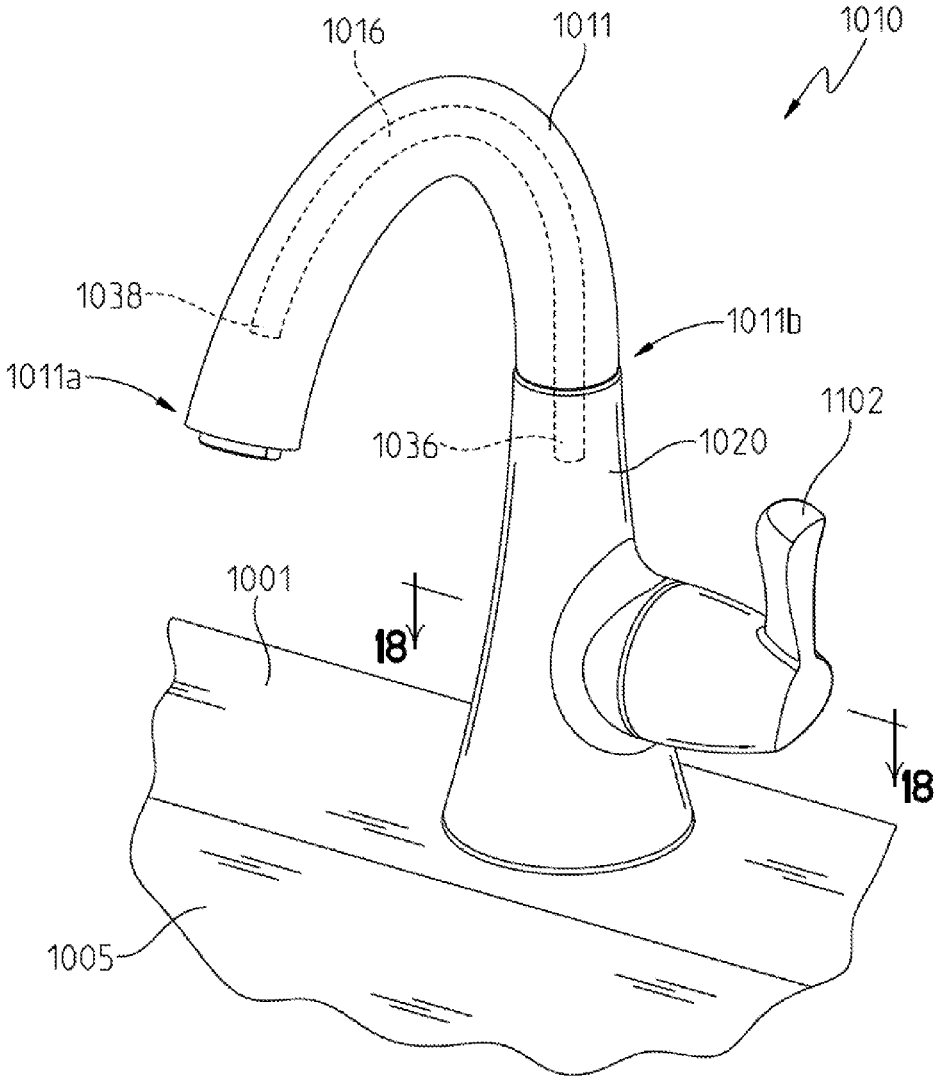
FIG. 12 is a perspective view of another illustrative embodiment single supply faucet of the present disclosure, the single supply faucet shown mounted to a sink basin.
Figure 13:
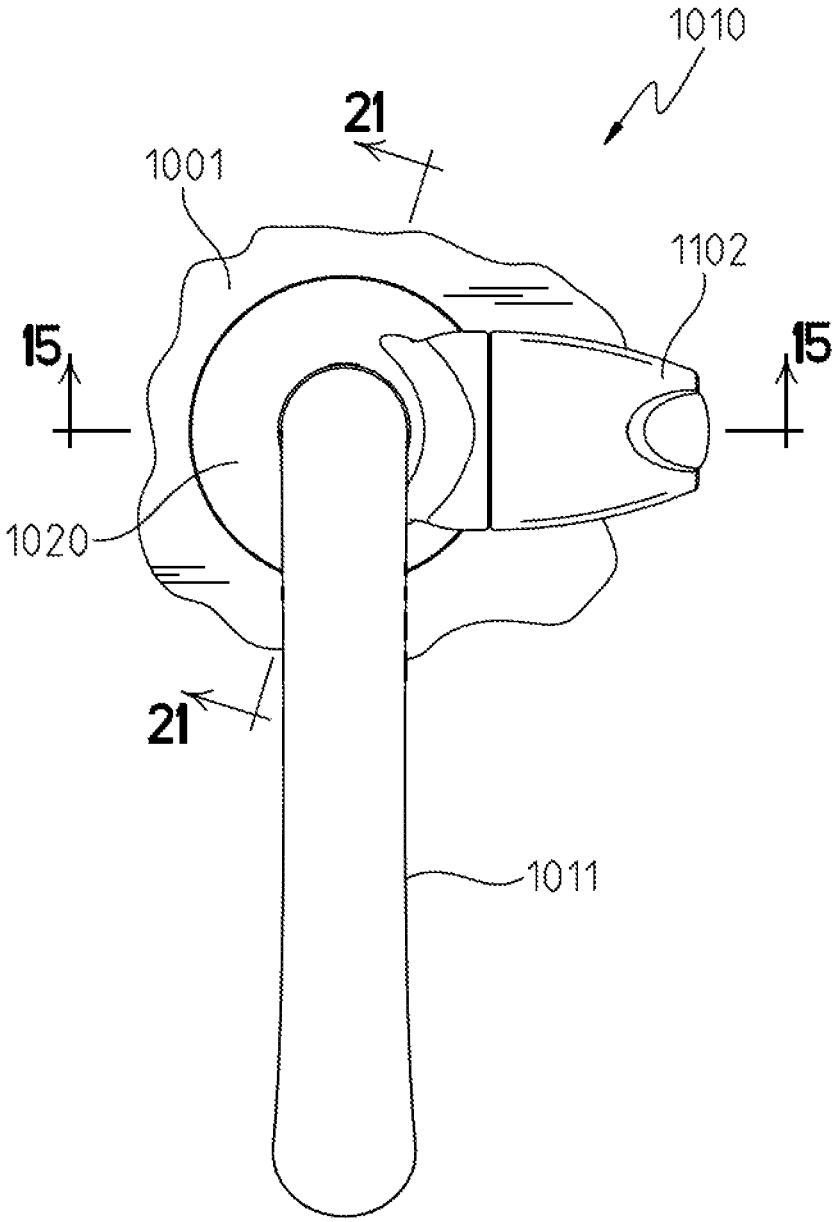
FIG. 13 is a top plan view of the faucet of FIG. 12.

Referring next to FIGS. 7-11, hub 20' of the illustrative faucet 10' includes internal rails 220' that are sized to receive and center rear protrusion 260' of waterway adapter 60' therebetween. Each rail 220' of hub 20' includes a downward-facing stop 222' that is configured to abut a corresponding upper shoulder 262' of waterway adapter 60'. Faucet 10' may be assembled by inserting waterway assembly 30' and waterway adapter 60' upwardly into body portion 20*a*' of hub 20' through the open first end 22' of hub 20'. As shown in FIG. 7, waterway adapter 60' and waterway assembly 30' are both narrower than the open first end 22' of hub 20' so that both components may be inserted upwardly into body portion 20*a*' of hub 20' through the open first end 22' of hub 20'. When upper shoulder 262' of waterway adapter 60' abuts stop 222' of hub 20', as shown in FIG. 7, the installer knows that waterway adapter 60' is properly positioned within body portion 20*a*' of hub 20' to align with valve assembly 100', both horizontally and vertically. Then, sleeve 106' may be screwed into valve portion 20*b*' of hub 20' such that first end 120' of sleeve 106' forces waterway adapter 60' into contact with rails 220' of hub 20', as shown in FIG. 10. With sleeve 106' tightened in place, waterway adapter 60' and waterway assembly 30' coupled thereto may be frictionally retained within hub 20' and may resist falling through open end 22' of hub 20' under gravitational force.

As shown in FIG. 7, valve assembly 100' is supported by valve portion 20*b*' of hub 20' and is removably coupled to waterway adapter 60' located in body portion 20*a*' of hub 20'. In this illustrative embodiment, valve assembly 100' may be removed from the open end 29' of valve portion 20*b*' of hub 20' for cleaning or servicing without having to remove waterway adapter 60' from body portion 20*a*' of hub 20'.

Valve body 108' may be removably coupled to waterway adapter 60' by fitting nut 105' over valve body 108', as shown in FIG. 7. In this arrangement, the externally threaded nut 105' may be screwed into the internally threaded second end 122' of sleeve 106'. Nut 105' may force valve body 108' tightly against waterway adapter 60'. Bonnet 104' may then be screwed onto the externally threaded nut 105' for receiving handle 102' thereon.

Referring to FIGS. 12-15, an illustrative embodiment of a single supply faucet 1010 is shown including a spout body 1011, a hub 1020, a waterway assembly 1030, a waterway adapter 1060, and a valve assembly 1100. In operation, single supply faucet 1010 receives water from a water supply (not shown) and forms an outlet stream. The water supply is not limited to traditional tap water and may include reverse osmosis water and filtered water, for example. An air gap assembly (not shown) may be provided for use with faucet 1010 if the water supply includes reverse osmosis water. The air gap assembly may be positioned below hub 1020 and may include an escutcheon or mounting cover that couples to hub 1020 and conceals air gap tubes, such as those for waste.

Faucet 1010 may be mounted to a sink deck 1001 or another suitable surface and may deliver the outlet stream from an outlet tube 1016 positioned within spout body 1011 into a sink basin 1005, for example. An aerator (not shown) also may be coupled to outlet tube 1016 at a first end 1011*a* of spout body 1011 to further facilitate the outlet flow of water. A conventional seal, illustratively a gasket 1018, may be positioned between hub 1020 and sink deck 1001 to resist water leakage from faucet 1010. Gasket 1018 may be comprised of a polymeric material or other suitable sealing materials (e.g., cork, metal).

Figure 14:
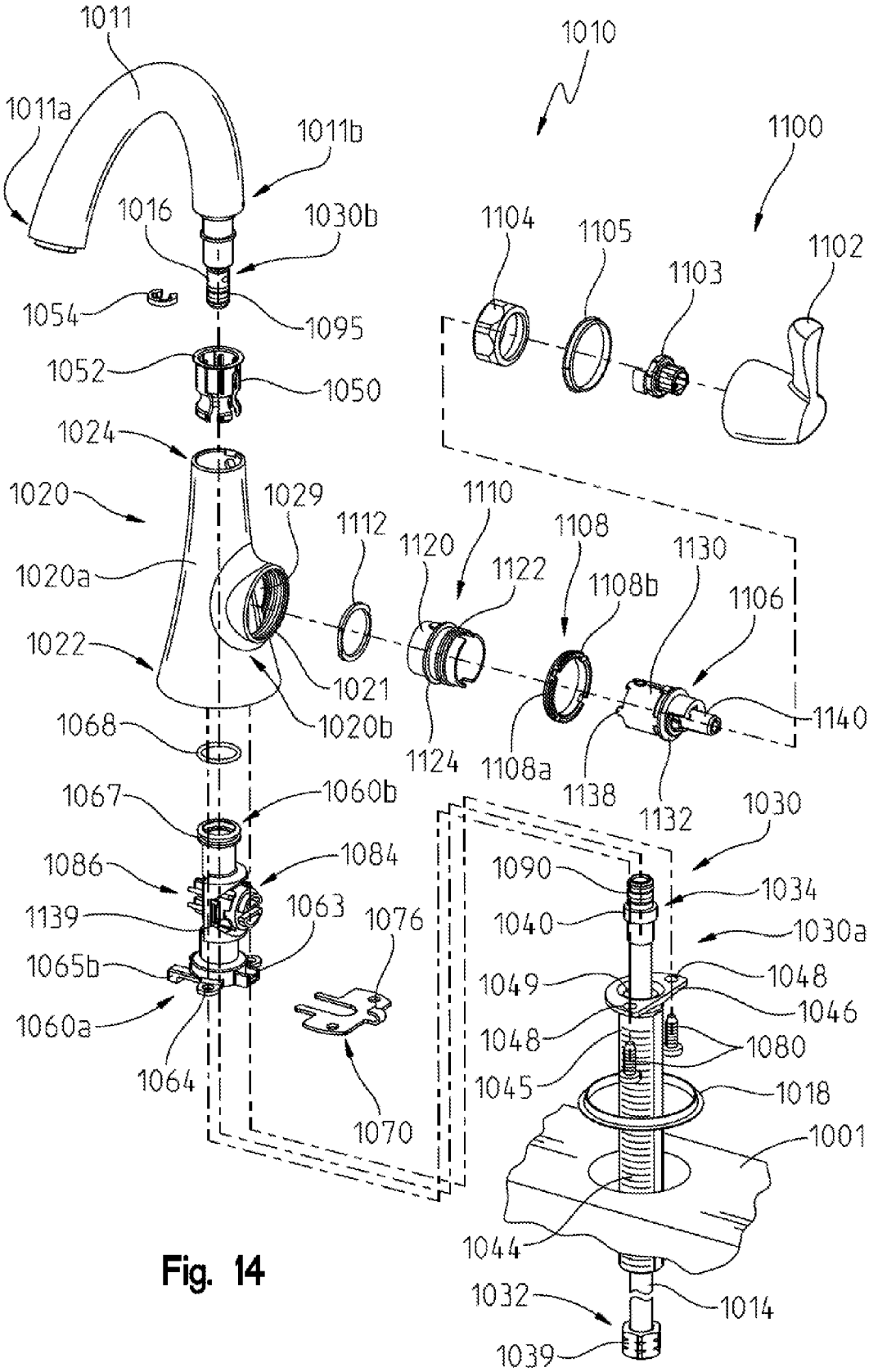
FIG. 14 is an exploded perspective view of the faucet of FIG. 12.
Figure 15:
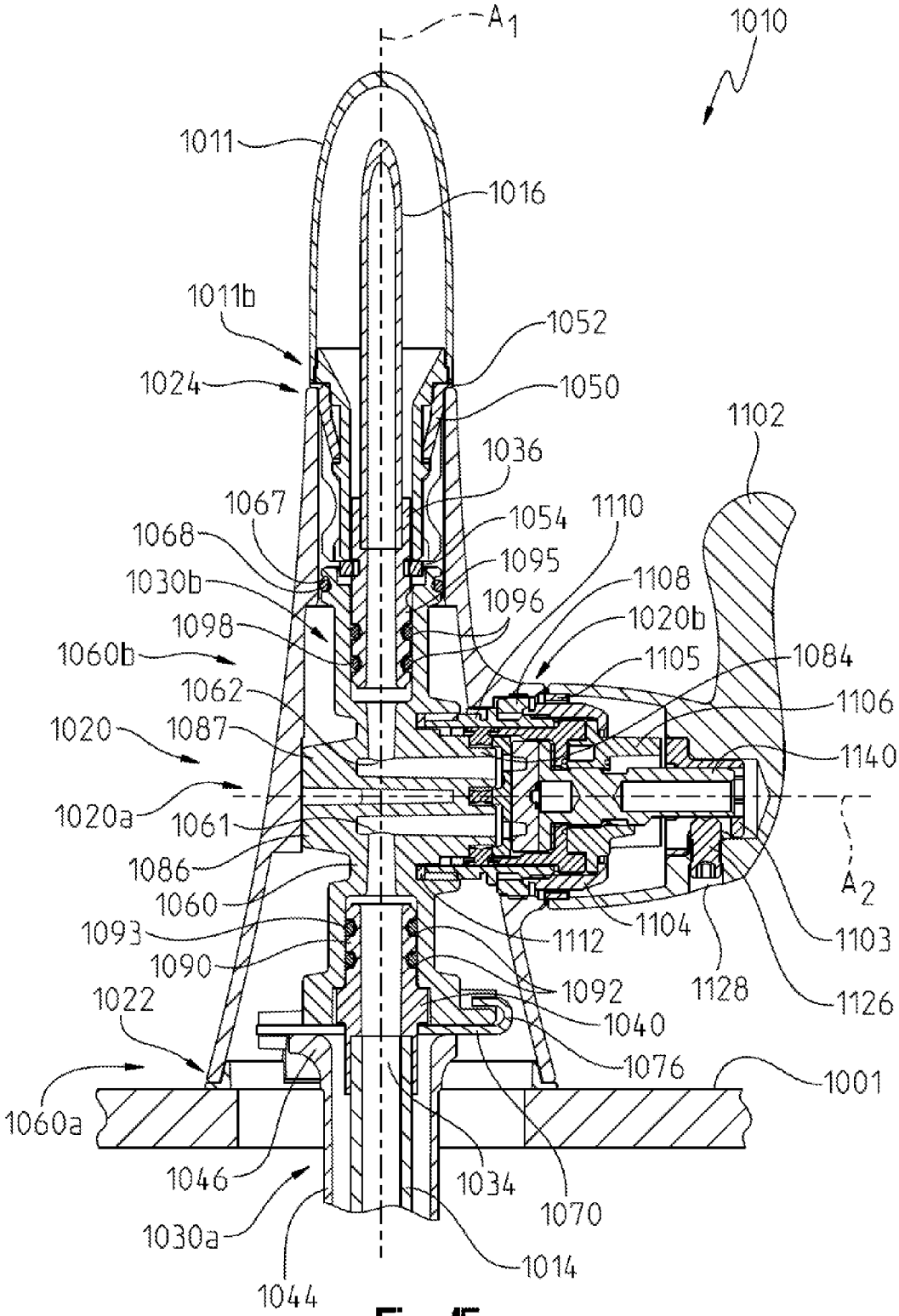
FIG. 15 is a cross-sectional view of the faucet of FIG. 13, taken along line 15-15 of FIG. 13.
Figure 17B:
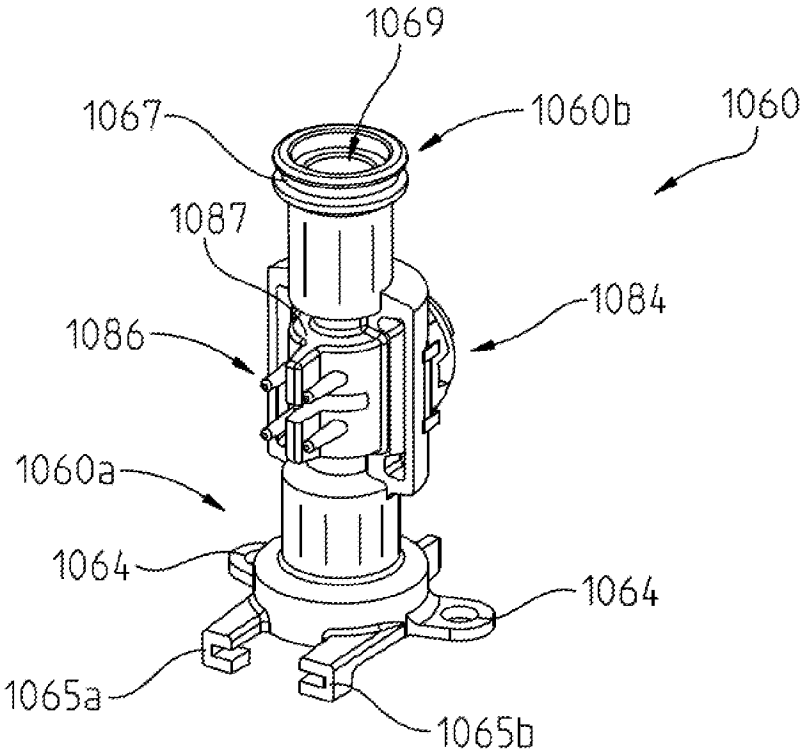
FIG. 17B is a rear perspective view of a waterway adapter configured to fit within the hub of FIG. 17A.
Figure 17A:
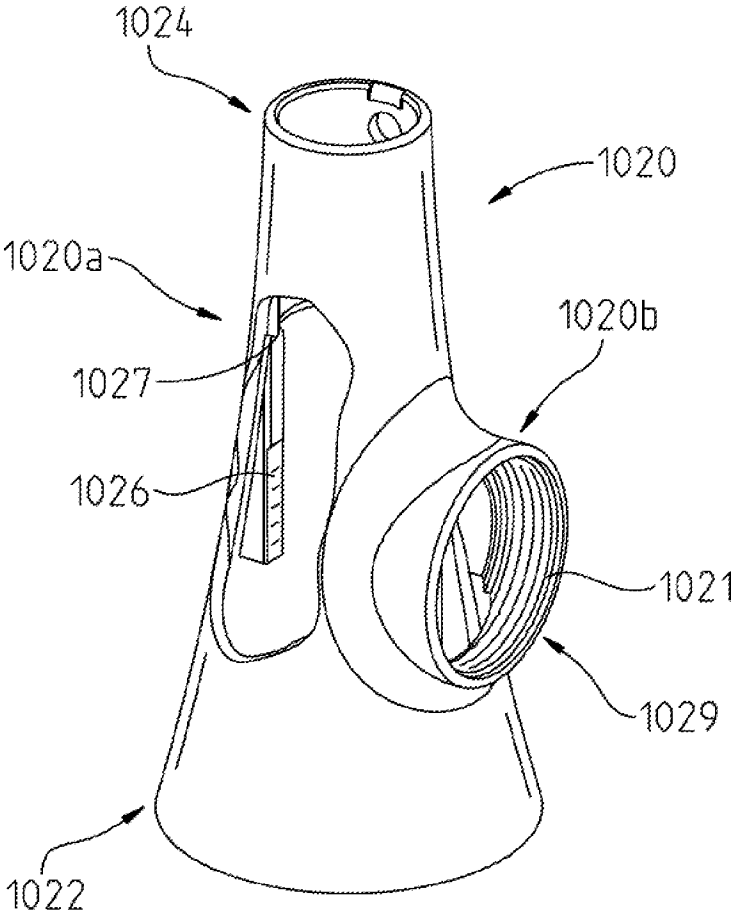
FIG. 17A is a side perspective view of the hub having a side portion removed to expose an internal rail.

With reference to FIGS. 14-15, the illustrative hub 1020 of faucet 1010 includes a vertically disposed body portion 1020*a* and a horizontally disposed valve portion 1020*b* that cooperate to define a generally hollow interior of hub 1020. Body portion 1020*a* extends along a generally vertical axis $A_1$ and valve portion 1020*b* extends transversely therefrom along a generally horizontal axis $A_2$. Body portion 1020*a* of hub 1020 includes an open bottom end 1022 that is configured to rest against sink deck 1001 or other suitable surfaces. Body portion 1020*a* of hub 1020 also includes an open top end 1024 that is configured to mate with spout body 1011. Top end 1024 of body portion 1020*a* may be further configured to engage with a spout retainer 1050 that is sized to receive outlet tube 1016 extending from a second end 1011*b* of spout body 1011, thereby securing spout body 1011 and outlet tube 1016 within hub 1020. Hub 1020 may also define one or more internally threaded bores 1028 (FIG. 21) for receiving a plurality of couplers or fasteners, illustratively screws 1080, therein, as discussed further below. Like body portion 1020*a* of hub 1020, valve portion 1020*b* of hub 1020 also includes an open end 1029 (FIG. 17A). Open end 1029 has a threaded surface 1021 (FIG. 17A). Open ends 1022, 1024 of body portion 1020*a* are longitudinally disposed, whereas open end 1029 of valve portion 1020*b* is laterally disposed at a substantially 90 degree angle from open ends 1022, 1024.

Hub 1020 of faucet 1010 may be formed of a traditional metallic material, such as zinc or brass. It is also within the scope of the present disclosure that hub 1020 may be formed of a non-metallic material, such as a polymer, illustratively a cross-linkable polymer. Suitable non-metallic materials that may be used to construct hub 1020 include cross-linkable polyethylene (PEX), polybutylene terephthalate (PBT), polyester, melamine, melamine urea, and melamine phenolic.

With continued reference to FIGS. 14-15, the illustrative waterway assembly 1030 of faucet 1010 includes an inlet portion 1030*a* having a single inlet tube 1014 and an outlet portion 1030*b* having single outlet tube 1016. As such, faucet 1010 is configured for use with a single water supply and, therefore, it is necessary to control only the flow, rather than the flow and the temperature, of the water through faucet 1010. Water inlet tube 1014 of waterway assembly 1030 may be fluidly coupled to a water supply (not shown) of cold water, filtered water, or reverse osmosis water, for example, in order to receive water into faucet 1010. Inlet tube 1014 extends between a first end 1032 and an opposing second end 1034. First end 1032 of inlet tube 1014 extends beneath hub 1020 and sink deck 1001 and may include conventional fluid couplings, such as nut 1039, for fluidly coupling inlet tube 1014 to the water supply.

Figure 23:
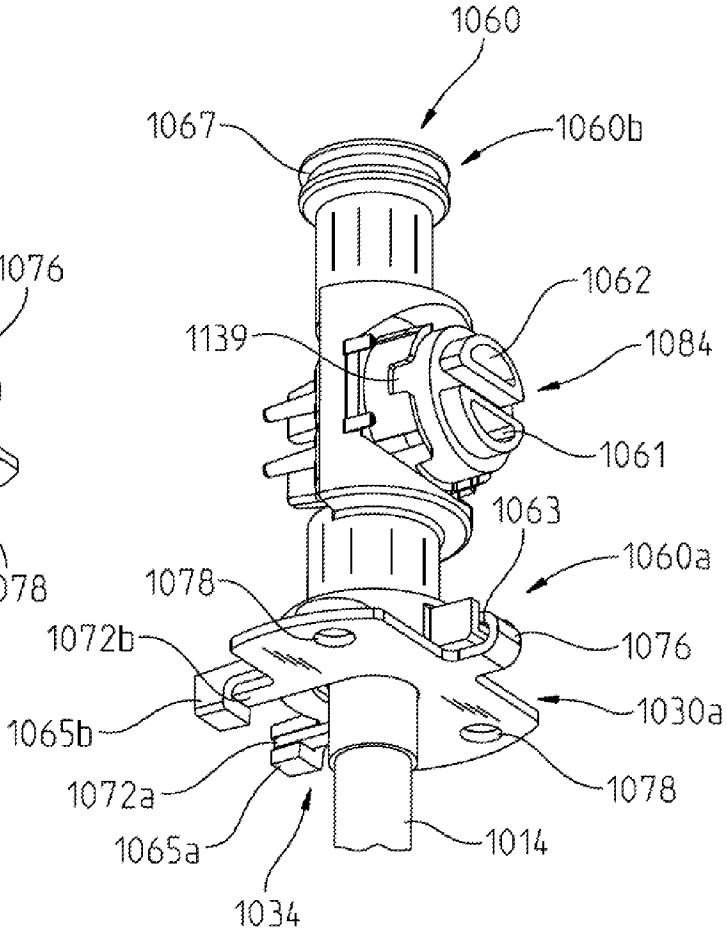
FIG. 23 is a bottom perspective view of the waterway adapter and the retainer clip of FIG. 22, shown with the retainer clip coupled to the waterway adapter.
Figure 22:
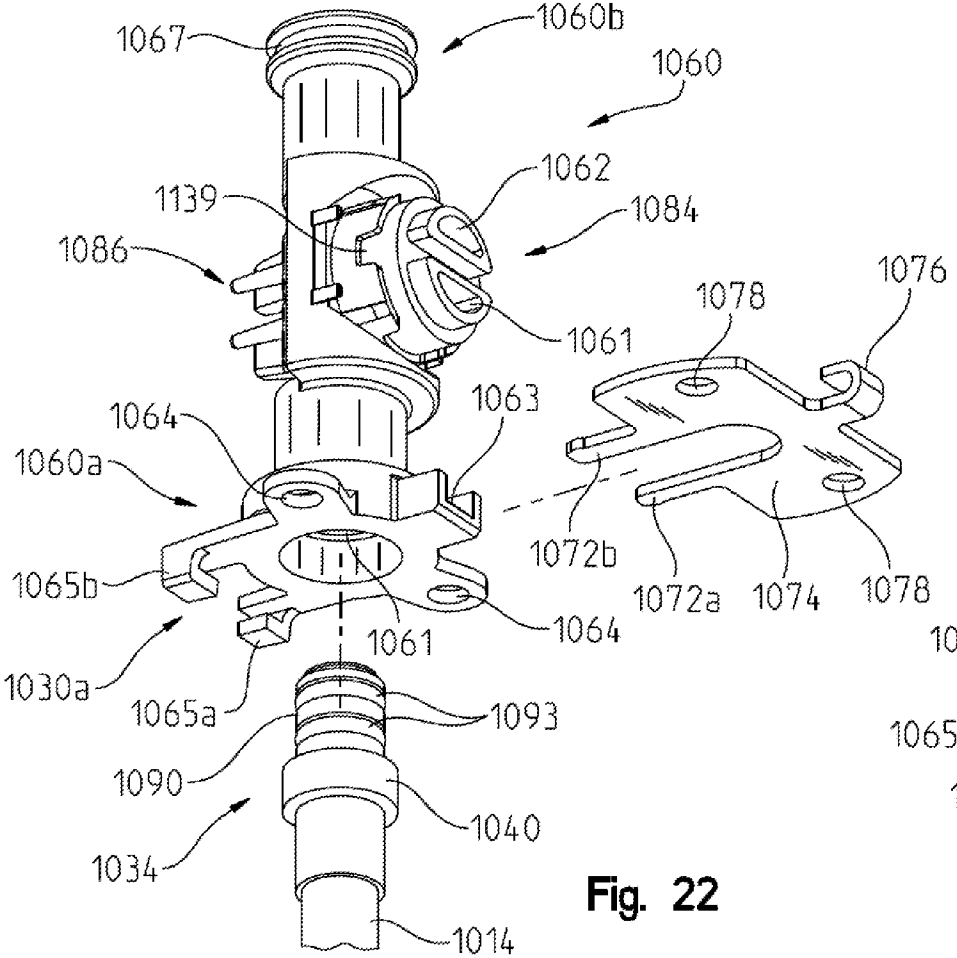
FIG. 22 is a bottom perspective view of the waterway adapter of FIG. 17B, including a retainer clip.

As is shown in FIGS. 15 and 22-23, second end 1034 of inlet tube 1014 may include a shoulder 1040 and a connector, illustratively a nipple 1090, received within hub 1020. Shoulder 1040 and nipple 1090 are coupled to inlet tube 1014 and more particularly, may be overmolded onto inlet tube 1014. Alternatively, shoulder 1040 and nipple 1090 may include internal projections or barbs (not shown) for gripping inlet tube 1014. Nipple 1090 may define one or more external, annular grooves 1092 for receiving one or more sealing rings 1093 therein. Illustratively, at least two grooves 1092 are defined on nipple 1090 and one sealing ring 1093 is retained within each of annular grooves 1092. Exemplary embodiments of sealing rings 1093 include o-rings comprised of a polymeric, rubber material. The double sealing ring feature of nipple 1090 resists water leakage between waterway adapter 1060 and inlet portion 1030*a* of waterway assembly 1030.

Referring to FIGS. 14-15, the illustrative inlet portion 1030*a* of waterway assembly 1030 of faucet 1010 is coupled to hub 1020 and sink deck 1001 by a supply shank 1044 and a mounting plate 1046. Furthermore, supply shank 1044 and mounting plate 1046 provide additional stability to faucet 1010 when in use. Supply shank 1044 is generally cylindrical in shape, having an opening (not shown) through which inlet tube 1014 is received. Inlet tube 1014 extends through a top portion 1045 of supply shank 1044 and is received through a central opening 1049 of mounting plate 1046, which corresponds to the opening in supply shank 1044. Illustratively, mounting plate 1046 entirely encloses central opening 1049, however, alternative embodiments of supply shank 1044 and mounting plate 1046 may be slitted to facilitate assembly onto waterway 1030, specifically inlet tube 1014. Mounting plate 1046 has a generally semi-circular shape and extends radially outward near top portion 1045 of supply shank 1010. Mounting plate 1046 includes at least one aperture configured to receive at least one of screws 1080. Illustratively, mounting plate 1046 includes two apertures 1048, each receiving one of screws 1080 in order to couple supply shank 1044 to hub 1020.

Referring to FIGS. 12-15, outlet tube 1016 of outlet portion 1030*b* of waterway assembly 1030 is fluidly coupled to waterway adapter 1060 for delivering water from faucet 1010. Illustratively, outlet portion 1030*b* is positioned opposite to inlet portion 1030*a* of waterway assembly 1030, such that outlet portion 1030*b* is substantially 180° from inlet portion 1030*a* and in axial alignment with inlet portion 1030*a* along generally vertical axis $A_1$. Outlet tube 1016 may include a first end 1036 fluidly coupled to waterway adapter 1060 and an opposing second end 1038 positioned near first end 1011*a* of spout body 1011. First end 1036 of outlet tube 1016 may include a connector, illustratively a nipple 1095, coupled to outlet tube 1016 and more particularly, nipple 1095 may be overmolded onto outlet tube 1016. Alternatively, nipple 1095 may include internal projections or barbs (not shown) for gripping outlet tube 1016. Nipple 1095 may have one or more external, annular grooves 1096 for receiving sealing rings 1098 therein. Illustratively, at least two grooves 1096 are defined on nipple 1095 of outlet tube 1016 and one sealing ring 1098 is retained within each of annular grooves 1096. As with sealing rings 1093, exemplary embodiments of sealing rings 1098 include o-rings comprised of a polymeric, rubber material. The double sealing ring feature of nipple 1095 resists water leakage between waterway adapter 1060 and outlet portion 1030*b* of waterway assembly 1030. Furthermore, this configuration provides faucet 1010 with stability and resistance to water pressure when in use.

Outlet portion 1030*b* of waterway assembly 1030 may further include spout retainer 1050 and a spout clip 1054 for coupling outlet tube 1016 to waterway adapter 1060. Spout retainer 1050 may extend within body portion 1020*a* of hub 1020 from top end 1024 of hub 1020 to a top end 1060*b* of waterway adapter 1060. Spout retainer 1050 includes a lip 1052 positioned intermediate spout body 1011 and top end 1024 of hub 1020. Spout retainer 1050 receives second end 1011*b* of spout body 1011, a portion of outlet tube 1016, and a portion of nipple 1095. Spout clip 1054 also assists in coupling outlet tube 1016 with waterway adapter 1060. More particularly, spout clip 1054 extends around the outer diameter of outlet tube 1016 and expands beneath spout retainer 1050 to function as a stop that prevents outlet tube 1016 from extending further into waterway adapter 1060 and/or out of waterway adapter 1060. Additionally, spout clip 1054 may abut second end 1011*b* of spout body 1011 to further retain outlet tube 1016 within spout body 1011.

To limit contact between the water in faucet 1010 and metallic components, waterway assembly 1030 may be formed of a flexible, non-metallic material, such as a polymer, illustratively a cross-linkable polymer. As such, waterway assembly 1030 is illustratively electrically non-conductive. In one illustrative embodiment, substantially the entire waterway assembly 1030 (including tubes 1014, 1016, shoulder 1040, nipples 1090, 1095, for example) is formed of a polyethylene which is subsequently cross-linked to form cross-linked polyethylene (PEX). Other suitable materials that may be used to construct waterway assembly 1030 include polyethylene (PE) (such as raised temperature resistant polyethylene (PE-RT)), polypropylene (PP) (such as polypropylene random (PPR)), and polybutylene (PB). It is further envisioned that waterway assembly 1030 may be constructed of cross-linked polyvinyl chloride (PVCX) using silane free radical initiators, cross-linked polyurethane, or cross-linked propylene (XLPP) using peroxide or silane free radical initiators. It is within the scope of the present disclosure that the polymer material used to construct waterway assembly 1030 may include reinforcing members, such as glass fibers.

Waterway assembly 1030 may be constructed by the method set forth in International Patent Application No. PCT/US10/25524 to Nelson et al., filed Feb. 26, 2010, entitled "FAUCET MANIFOLD," the disclosure of which is expressly incorporated by reference herein. In a first step of the illustrative method, nipples 1090, 1095 may be overmolded onto the corresponding tubes 1014, 1016 such that inlet tube 1014 has a material-to-material bond with nipple 1090 and shoulder 1040 and outlet tube has a material-to-material bond with nipple 1095. Alternatively, nipples 1090, 1095 may be inserted into the corresponding tubes 1014, 1016 with barbs (not shown) engaging tubes 1014, 1016 to resist withdrawal of nipples 1090, 1095 from the corresponding tubes 1014, 1016. Other alternative methods include coupling nipples 1090, 1095 to tubes 1014, 1016, respectively, through other conventional coupling means (e.g., friction hold). In a second step of the illustrative method, the assembled waterway assembly 1030 is optionally cross-linked.

With reference to FIGS. 14-15 and 21-23, the illustrative waterway adapter 1060 of single supply faucet 1010 is configured to be positioned and inserted into hub 1020 along the generally vertical axis $A_1$ and fluidly couples waterway assembly 1030 to valve assembly 1100. Waterway adapter 1060 includes a bottom end 1060*a* that defines a water inlet channel 1061 and the opposing top end 1060*b* that defines a water outlet channel 1062. In the illustrative embodiment, channels 1061, 1062 are L-shaped or bent at a substantially 90° angle to couple the vertically disposed waterway assembly 1030 to the horizontally disposed valve assembly 1100. As shown in FIG. 15, rather than using a threaded connection, inlet channel 1061 of waterway adapter 1060 is sized to receive nipple 1090 of water inlet tube 1014 through a friction hold in order to maximize the water passageway. Sealing rings 1093 provided within grooves 1092 of nipple 1090, as discussed above, may resist leakage between inlet portion 1030*a* of waterway assembly 1030 and bottom end 1060*a* of waterway adapter 1060. Similarly, rather than using a threaded connection, outlet channel 1062 of waterway adapter 1060 is sized to frictionally engage with and receive nipple 1095 of outlet tube 1016. Sealing rings 1098 may cooperate with grooves 1096 to prevent water leakage between outlet portion 1030*b* of waterway assembly 1030 and top end 1060*b* of waterway adapter 1060.

Top end 1060*b* of waterway adapter 1060 includes at least one annular groove 1067 configured to receive a sealing ring 1068. Illustratively, sealing ring 1068 is an o-ring comprised of polymeric, rubber material; however, sealing ring 1068 could be any sealing member capable of cooperating with groove 1067 to resist water leakage between waterway adapter 1060 and hub 1020. Top end 1060*b* of waterway adapter 1060 further includes a seat 1069 for receiving spout clip 1054, when clip 1054 is coupled to outlet tube 1016. As such, spout clip 1054 may be intermediate top end 1060*b* of waterway adapter 1060 and second end 1011*b* of spout body 1011.

Bottom end 1060*a* of waterway adapter 1060 includes apertures 1064 that receive screws 1080 therethrough for coupling waterway adapter 1060 to waterway assembly 1030 and hub 1020. Apertures 1064 are generally disposed along opposing sides of bottom end 1060*a* of waterway adapter 1060 and correspond to apertures 1048 of mounting plate 1046, such that screws 1080 also may be received therethrough.

Figure 21:
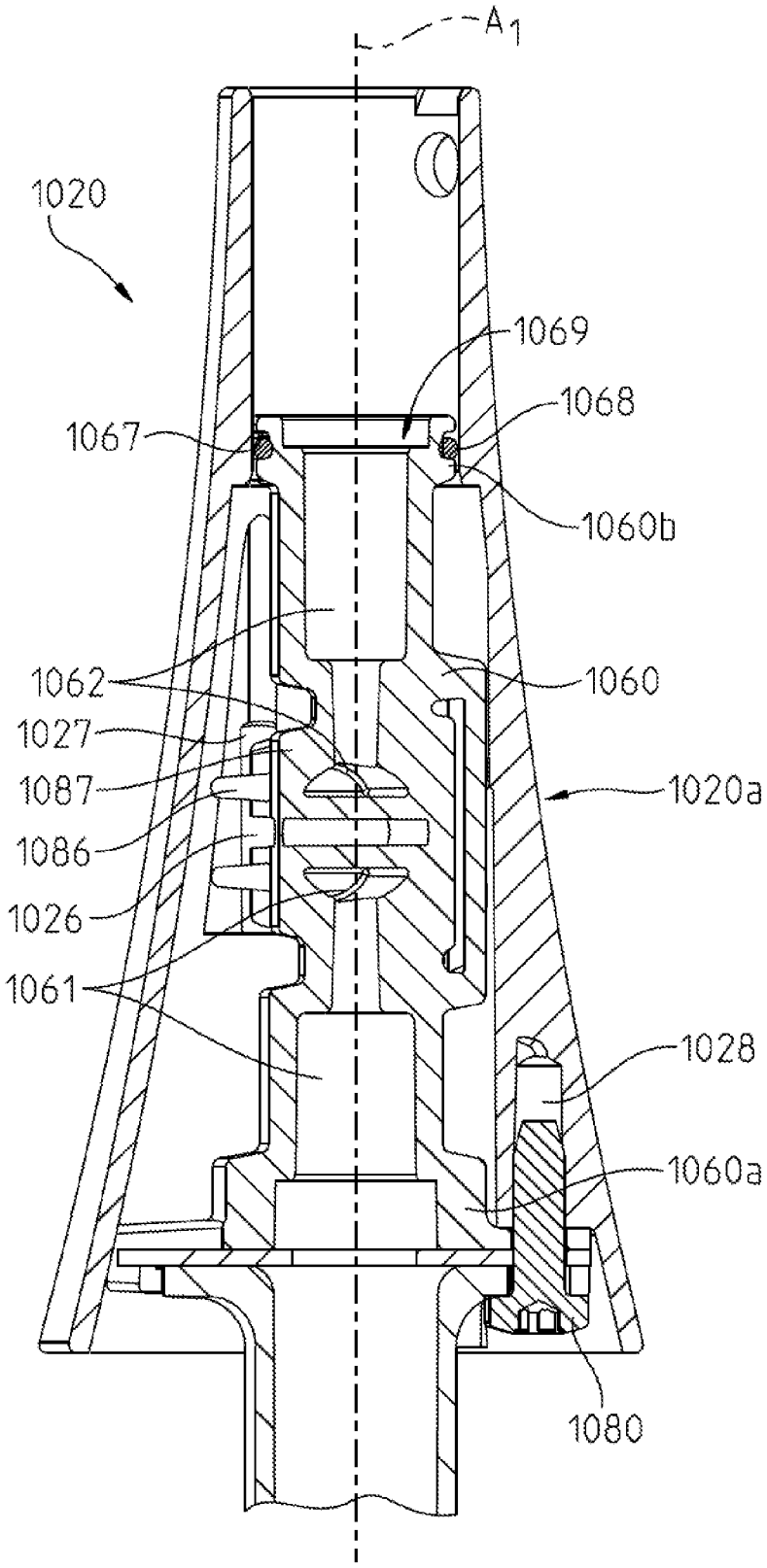
FIG. 21 is a cross-sectional view of the faucet of FIG. 13, taken along line 21-21 of FIG. 13, shown with the waterway adapter inside the hub.

Referring next to FIGS. 17A, 17B, and 21-23, hub 1020 of the illustrative faucet 1010 includes an internal rail 1026 that is sized to guide a central rear portion 1086 of waterway adapter 1060. Central rear portion 1086 is U-shaped and includes an upper shoulder 1087. Rail 1026 extends vertically within hub 1020 and is configured to slide along central rear portion 1086 of waterway adapter 1060 during assembly of faucet 1010. Rail 1026 includes a downward-facing stop 1027 that is configured to abut upper shoulder 1087 of waterway adapter 1060. In this way, assembly of faucet 1010 may be made easier because waterway adapter 1060 is self-aligning within hub 1020 due to rail 1026 guiding waterway adapter 1060 when inserted through open end 1022 of hub 1020. When upper shoulder 1087 of waterway adapter 1060 abuts stop 1027 of hub 1020, as shown in FIG. 21, the installer knows that waterway adapter 1060 is properly positioned within body portion 1020*a* of hub 1020 to align with valve assembly 1100, both horizontally and vertically.

To further limit contact between the water in faucet 1010 and metallic components, waterway adapter 1060 may be comprised of a non-metallic material, such as a polymer, and formed using molding processes (e.g., injection molding, compression molding). In one illustrative embodiment, waterway adapter 1060 is formed of a glass fiber reinforced polysulfone, such as Udel® GF-110, which is a registered trademark of Solvay Advanced Polymers of Alpharetta, Ga. In another illustrative embodiment, waterway adapter 1060 is formed of polyethylene, which may be subsequently cross-linked to form cross-linked polyethylene (PEX). Other suitable materials that may be used to construct waterway adapter 1060 include polyethylene (PE) (such as raised temperature resistant polyethylene (PE-RT)), polypropylene (PP) (such as polypropylene random (PPR)), and polybutylene (PB). It is further envisioned that waterway adapter 1060 may be constructed of cross-linked polyvinyl chloride (PVCX) using silane free radical initiators, cross-linked polyurethane, or cross-linked propylene (XLPP) using peroxide or silane free radical initiators. It is within the scope of the present disclosure that the polymer material used to construct waterway adapter 1060 may include reinforcing members, such as glass fibers.

With reference to FIGS. 14-15 and 22-23 waterway adapter 1060 may be coupled to inlet tube 1014 with a coupler, illustratively a retainer clip 1070. Retainer clip 1070 may be positioned substantially around inlet tube 1014 intermediate shoulder 1040 and mounting plate 1046 such that shoulder 1040 rests atop retainer clip 1070 in order to couple inlet tube 1014 to waterway adapter 1060. As such, retainer clip 1070 prevents inlet tube 1014 from falling out of waterway adapter 1060 and through supply shank 1044. Retainer clip 1070 includes ears 1074, tab 1076, and fingers 1072, illustratively, a first finger 1072*a* and a second finger 1072*b*. Each of ears 1074 include at least one aperture 1078, which corresponds to apertures 1048 of mounting plate 1046 and apertures 1064 of waterway adapter 1060, to receive screws 1080 therethrough. In this way, screws 1080 coupling supply shank 1044, retainer clip 1070, and waterway adapter 1060 within hub 1020. Fingers 1072*a*, 1072*b* of retainer clip 1070 are configured to slide along a plurality of tracks 1065, illustratively track 1065*a* and track 1065*b*, on bottom end 1060*a* of waterway adapter 1060, whereby tab 1076 couples with a recess 1063 on waterway adapter 1060. In order to prevent retainer clip 1070 from being incorrectly coupled to waterway adapter 1060, finger 1072*a* corresponds to track 1065*a* and finger 1072*b* corresponds to track 1065*b* of waterway adapter 1060. Illustratively, both finger 1072*b* and track 1065*b* are wider than finger 1072*a* and corresponding track 1065*a*, such that finger 1072*b* is too wide to slide along track 1065*a*. Alternatively, finger 1072*b* may be thicker than finger 1072*a* and, therefore, is also prevented from sliding along track 1065*a*, such that finger 1072*b* must only slide along track 1065*b*. Furthermore, visual inspection of retainer clip 1070 suggests that tab 1076 engages or couples with recess 1063 of waterway adapter 1060, thereby further preventing misalignment and incorrect positioning of retainer clip 1070 with respect to waterway adapter 1060.

Functionally, this reinforced coupling between waterway adapter 1060 and retainer clip 1070, provided by screws 1080, tab 1076, and fingers 1072 engaged with tracks 1065, is meant to dually couple inlet tube 1014 with waterway adapter 1060. Without retainer clip 1070, inlet tube 1014 may fall through supply shank 1044, regardless of whether or not screws 1080 are coupled to hub 1020. As such, if screws 1080 do fail, inlet tube 1014 remains coupled to waterway adapter 1060 by retainer clip 1070; however, because screws 1080 may couple with faucet 1010 from underneath sink deck 1001, if screws 1080 fail, hub 1020 may no longer be coupled with sink deck 1001. In this way, retainer clip 1070 resists leakage from faucet 1010 if mounting plate 1046 and/or screws 1080 become uncoupled from hub 1020. Alternative embodiments of faucet 1010 include additional couplers for securing faucet 1010 to sink deck 1001 if screws 1080 are not configured for that purpose.

Figure 18:
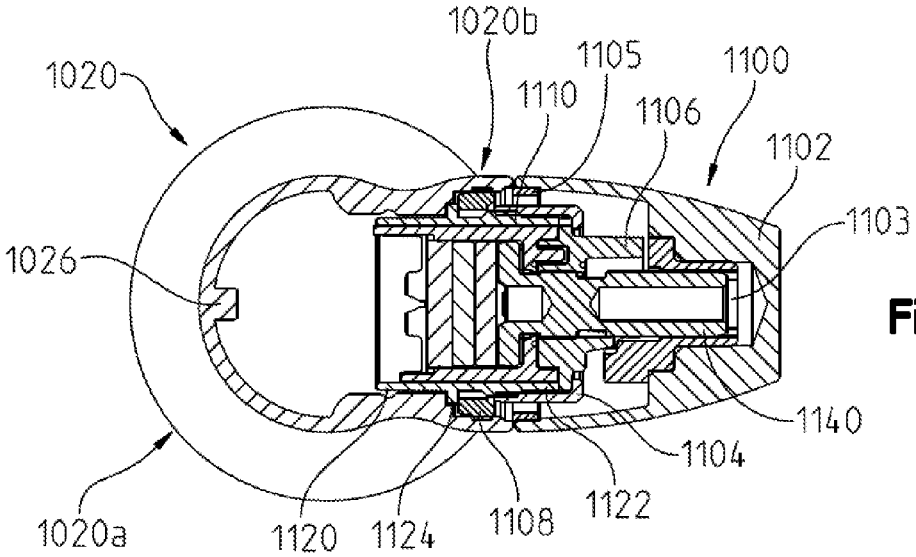
FIG. 18 is a cross-sectional view of the faucet of FIG. 12, taken along line 18-18 of FIG. 12, shown with the waterway adapter removed from the hub and a valve assembly coupled to the hub.
Figure 19:
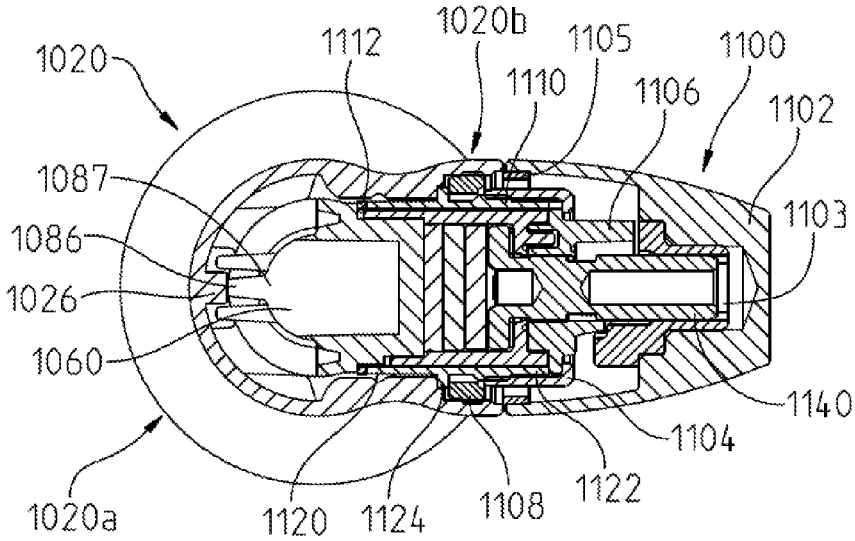
FIG. 19 is a cross-sectional view similar to FIG. 18, shown with the waterway adapter inside the hub and the valve assembly coupled to the hub.
Figure 20:
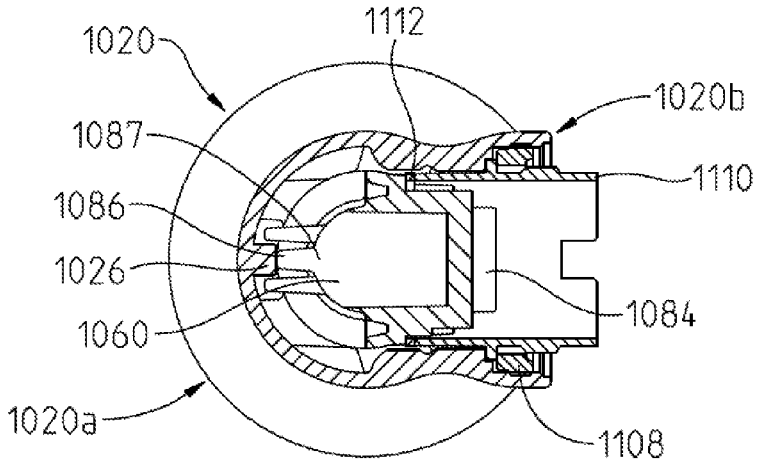
FIG. 20 is a cross-sectional view similar to FIG. 18, shown with the waterway adapter inside the hub with the valve assembly removed.

Referring back to FIGS. 14-16, the illustrative valve assembly 1100 of faucet 1010 is positioned along the generally horizontal axis $A_2$ and, as such, is substantially perpendicular to body portion 1020*a* of hub 1020. Valve assembly 1100 includes a handle 1102, a stem enclosure 1103, a bonnet 1104, a sealing member 1105, a valve body 1106, a retaining ring 1108, a sleeve 1110, and a washer 1112. Valve assembly 1100 is supported by valve portion 1020*b* of hub 1020 and is removably coupled to waterway adapter 1060 located within body portion 1020*a* of hub 1020. As such, valve assembly 1100 is generally positioned at a right angle to inlet supply tube 1014 and outlet supply tube 1016 when coupled to hub 1020. Exemplary valve assembly 1100 is a flow control type configured to adjust the flow rate of water through faucet 1010. It is unnecessary to adjust the temperature of the water because, illustratively, inlet tube 1014 is the only inlet stream of water entering valve assembly 1100. Therefore, valve assembly 1100 is not configured to mix multiple water streams and control the temperature of the outlet stream. In this illustrative embodiment, valve assembly 1100 is sized for insertion into open end 1029 of valve portion 1020*b* of hub 1020 in order to couple with waterway adapter 1060; however, valve assembly 1100 also may be removed from the open end 1029 for cleaning or servicing without removing waterway adapter 1060 from body portion 1020*a* of hub 1020. As such, hub 1020 supports waterway adapter 1060 independently of valve assembly 1100, as is shown in FIGS. 18-20.

Figure 16:
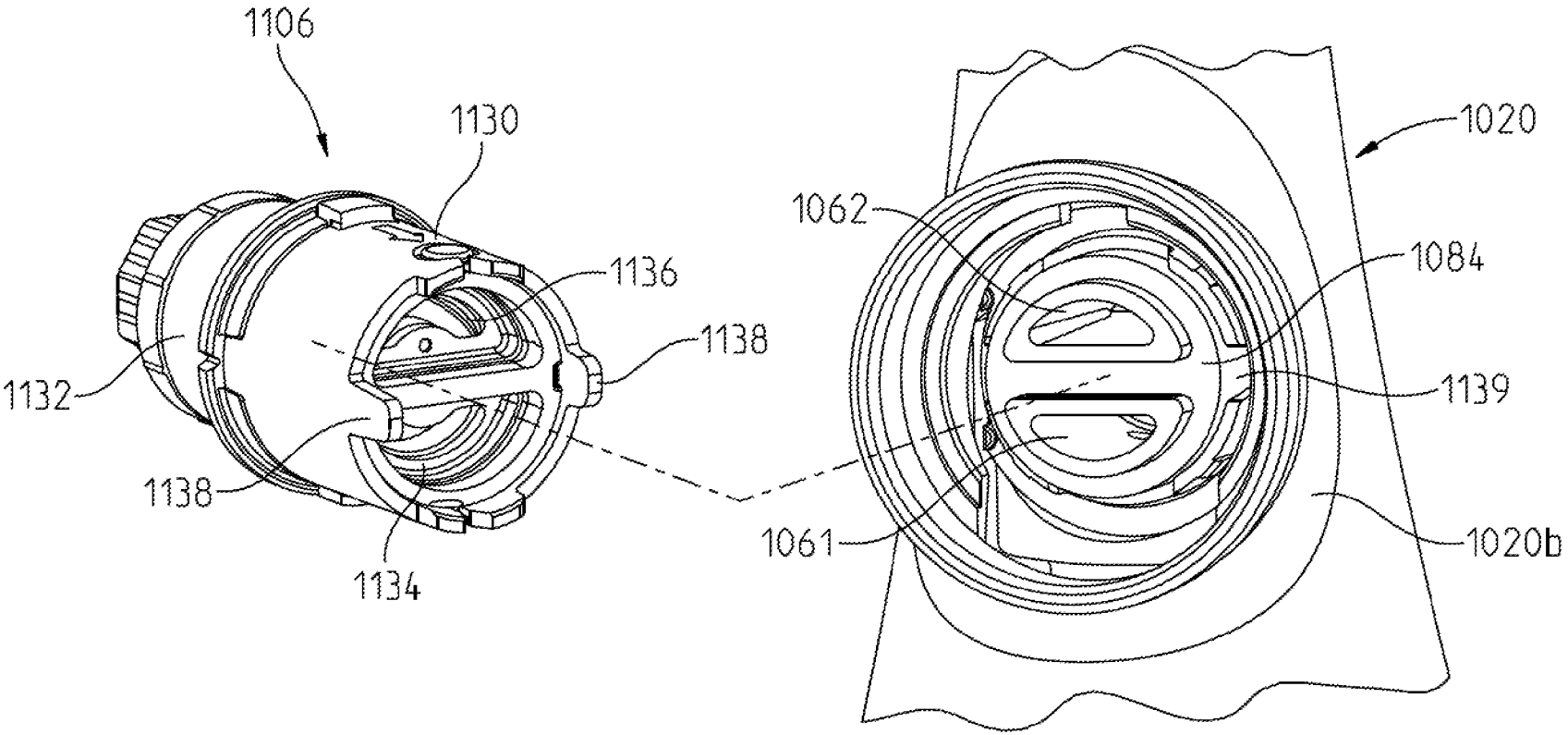
FIG. 16 is an exploded perspective view of a hub and a valve body of the faucet of FIG. 14.

Valve body 1108 may be of the type further detailed in U.S. patent application Ser. No. 12/994,968 to Thomas et al., filed Nov. 29, 2010, entitled "VALVE ASSEMBLY FOR A TWO HANDLE FAUCET," the disclosure of which is expressly incorporated by reference herein. As shown in FIG. 16, valve body 1106 may include a lower housing 1130 and an upper housing 1132. Valve body 1106 also includes a water inlet port 1134 and a water outlet port 1136. When assembled, water inlet port 1134 of valve body 1106 is arranged in fluid communication with water inlet channel 1061 of waterway adapter 1060 and outlet port 1136 of valve body 1106 is arranged in fluid communication with outlet channel 1062 of waterway adapter 1060. Lower housing 1130 of valve body 1106 may seal against a central front portion 1084 of waterway adapter 1060 to resist leakage between the components.

One or more locating elements, illustratively protrusions 1138, extend from lower housing 1130 of valve body 1106 to assist with coupling valve body 1106 to waterway adapter 1060. Protrusions 1138 mate with one or more corresponding cavities 1139 (FIGS. 22-23) of central front portion 1084 of waterway adapter 1060. Positioning each protrusion 1138 within a corresponding cavity 1139 facilitates proper orientation of valve body 1106 relative to waterway adapter 1060, and as a result, proper orientation of valve body 1106 relative to waterway assembly 1030. More particularly, protrusions 1138 of valve body 1106 assist in proper orientation of tubes 1014, 1016 and nipples 1090, 1095 of waterway assembly 1030, channels 1061, 1062 of waterway adapter 1060, and ports 1134, 1136 of valve body 1106, respectively. Also, the mating of protrusions 1138 and cavities 1139 may improve resistance to torque generated between hub 1020, waterway assembly 1030, waterway adapter 1060, and valve assembly 1100.

Single supply faucet 1010 may be assembled by inserting waterway adapter 1060 and inlet portion 1030*a*, including inlet tube 1014, of waterway assembly 1030 upwardly into body portion 1020*a* of hub 1020 through the open bottom end 1022 of hub 1020. More particularly, internal rail 1026 and stop 1027 of hub 1020 guide waterway adapter 1060 into proper alignment within hub 1020. Retainer clip 1070 couples inlet tube 1014 to waterway adapter 1060 prior to inserting waterway adapter 1060 into hub 1020. As shown in FIGS. 14-15, waterway adapter 1060 and inlet portion 1030*a* of waterway assembly 1030 are both narrower than open bottom end 1022 of hub 1020 so that both components may be inserted upwardly into body portion 1020*a* of hub 1020. When assembled, screws 1080 extend through apertures 1048 in mounting plate 1046, through apertures 1078 of retainer clip 1070, through apertures 1064 of waterway adapter 1060, and into internally threaded bores 1028 (FIG. 21) of hub 1020, thereby securing inlet portion 1030*a* of waterway assembly 1030 and waterway adapter 1060 into body portion 1020*a* of hub 1020.

Outlet portion 1030*b* of waterway assembly 1030 may be assembled by positioning spout retainer 1050 within top end 1024 of hub 1020 and inserting outlet tube 1016 through spout retainer 1050 and into top end 1060*b* of waterway adapter 1060 until spout clip 1054 expands open to lock the components in place. Spout body 1011 may be assembled with spout retainer 1050 and top end of 1024 of hub 1020, as is shown in FIGS. 14-15.

During assembly of valve assembly 1100 with hub 1020, washer 1012 is configured to be received through open end 1029 of valve portion 1020*b* of hub 1020 and mate with central front portion 1084 of waterway adapter 1060. Illustratively, washer 1112 is a circular member extending completely around central portion 1084 and may be positioned within body portion 1020*a* of hub 1020 when coupled with waterway adapter 1060. Sleeve 1110 of the illustrative valve assembly 1100 is positioned adjacent to washer 1112 and is received around central front portion 1084, extending between body portion 1020*a* and valve portion 1020*b* of hub 1020, when coupled with waterway adapter 1060. Sleeve 1110 includes a first end 1120, a second end 1122, and a stop surface 1124 positioned therebetween and protruding radially outward from the perimeter of sleeve 1110. Illustratively, valve body 1106 is removably coupled to waterway adapter 1060 by fitting sleeve 1110 over valve body 1106 and coupling retaining ring 1108 and bonnet 1104 against sleeve 1110. More, particularly, retaining ring 1108 slides over second end 1122 of sleeve 1110 and is positioned adjacent to and in contact with stop surface 1124 of sleeve 1110. Retaining ring 1108 includes an externally threaded end 1108*a* which engages with threaded surface 1021 of valve portion 1020*b* and abuts stop surface 1124 of sleeve 1110 to threadedly couple valve assembly 1100 to valve portion 1020*b*. Bonnet 1104 further slides over second end 1122 of sleeve 1110 and threadedly couples with an internally threaded end 1108*b* of retaining ring 1108 to force valve body 1106 against waterway adapter 1060, thereby engaging washer 1112 to reduce leakage between waterway adapter 1060 and valve portion 1020*b*. To further reduce leakage from valve portion 1020*b* of hub 1020, sealing member 1105 is received over bonnet 1104. Illustratively, a portion of sealing member 1105 is positioned between valve portion 1020*b* and handle 1102. Stem enclosure 1103 is provided intermediate upper housing 1132 of valve body 1106 and handle 1102 to receive a stem 1140, coupled to valve body 1106, and transmits motion from handle 1102 to stem 1140, and therefore, to valve body 1106. Handle 1102 may be received over stem enclosure 1103 and bonnet 1104 and further secured to valve assembly 1100 using conventional couplers or fasteners, illustratively, a screw 1126 received within an aperture 1128 of handle 102 (FIG. 15).

When sleeve 1110 is inserted into valve portion 1020*b* of hub 1020, sleeve 1110 forces waterway adapter 1060 into contact with rail 1026 of hub 1020, as shown in FIG. 21. With sleeve 1110 in place, waterway adapter 1060 and waterway assembly 1030 coupled thereto may be frictionally retained within hub 1020 and may resist falling through open end 1022 of hub 1020 under gravitational force. Additionally, screws 1080 provide further assurance that waterway adapter 1060 will remain within hub 1020 if valve assembly 1100 is removed.

The illustrative valve assembly 1100 may be operated by adjusting or moving handle 1102 relative to hub 1020. Handle 1102 may be moveable about at least generally horizontal axis $A_2$. Adjusting handle 1102 actuates stem 1140 and stem enclosure 1103, both of which transmit movement of handle 1102 to valve body 1106. Therefore, by adjusting handle 1102, a user is able to selectively vary the flow rate of water supplied to outlet port 1136 of valve body 1106. Furthermore, because waterway assembly 1030 is in fluid communication with valve body 1106 via waterway adapter 1060, adjusting handle 1102 allows a user to selectively vary the flow rate of water supplied to outlet channel 1062 of waterway adapter 1060 and outlet tube 1016 from water inlet tube 1014 and inlet channel 1061 of waterway adapter 1060. While the illustrative valve assembly 1100 is of a movable disc variety, it should be appreciated that other types of valve assemblies may be substituted therefor. For example, a ball-type mixing valve assembly may find equal applicability with the present invention.

In use, water flows from the water supply (not shown) to valve assembly 1100 of faucet 1010. Water flows vertically along generally vertical axis $A_1$ from the water supply (e.g., cold water, filtered water, reverse osmosis water) via water inlet tube 1014 and nipple 1090 of waterway assembly 1030 and bends at a right angle after entering water inlet channel 1061 of waterway adapter 1060 to follow generally horizontal axis $A_2$ in order to enter water inlet port 1134 of valve assembly 1100. Then, with the adjustment of handle 1102, the outlet water stream flows horizontally from outlet port 1136 of valve assembly 1100, through a portion outlet channel 1062 of waterway adapter 1060, and then travels through a generally right angle bend in channel 1062 to vertically travel along vertical axis $A_l$ through outlet nipple 1095 and outlet tube 1016 of waterway assembly 1030.

Referring next to FIGS. 24-34, another illustrative embodiment of a faucet 1010' is shown including a spout body 1011', a hub 1020', a waterway assembly 1030', a waterway adapter 1060', and two valve assemblies, illustratively a cold water valve assembly 1100*b*' and a hot water valve assembly 1100*c*'. Faucet 1010' of FIGS. 24-34 includes features similar to those of faucet 1010 of FIGS. 12-23, with like reference numerals indicating like elements, except as described below.

Referring to FIGS. 24-27, in operation, two-handle faucet 1010' receives water from a hot water supply and a cold water supply (not shown) and mixes the incoming water to form an outlet stream. Faucet 1010' may be mounted to a sink deck 1001' or another suitable surface and may deliver the outlet stream from an outlet tube 1016' positioned within spout body 1011' into a sink basin 1005', for example. An aerator (not shown) also may be coupled to outlet tube 1016' at a first end 1011*a*' of spout body 1011' to further facilitate the outlet flow of water. A conventional seal, illustratively a gasket 1018', may be positioned between hub 1020' and sink deck 1001' to resist water leakage between faucet 1010' and sink deck 1001'.

The illustrative hub 1020' of faucet 1010' includes a vertically disposed body portion 1020*a*', a first horizontally disposed valve portion 1020*b*', and an opposing second horizontally disposed valve portion 1020*c*' that cooperate to define a generally hollow interior of hub 1020'. Body portion 1020*a*' extends along a generally vertical axis $A_1$' and valve portions 1020*b*', 1020*c*' extend transversely therefrom along a generally horizontal axis $A_2$'. More particularly, illustrative valve portions 1020*b*', 1020*c*' are positioned along opposite sides of body portion 1020*a*' of hub 1020', with valve portion 1020*b*' extending a first direction along generally horizontal axis $A_2$' and valve portion 1020*c*' extending in an opposing second direction along generally horizontal axis $A_2$'. As such, generally vertical axis $A_1$' is substantially equidistant from valve portion 1020*b*' and valve portion 1020*c*'. Body portion 1020*a*' of hub 1020' includes an open bottom end 1022' that is configured to rest against sink deck 1001' or other suitable surfaces.

Figure 31:
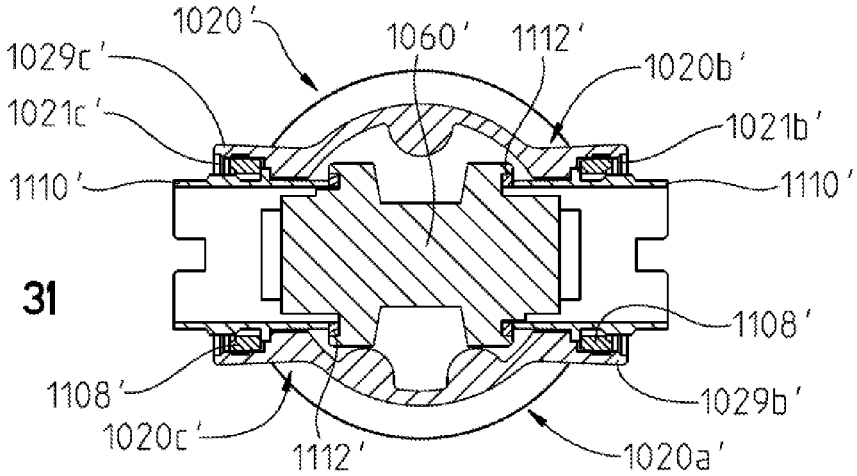
FIG. 31 is a cross-sectional view similar to FIG. 29, shown with the waterway adapter inside the hub with the valve assemblies removed.

Body portion 1020*a*' of hub 1020' also includes an open top end 1024' that is configured to mate with spout body 1011'. Top end 1024' of body portion 1020*a*' may be further configured to engage with a spout retainer 1050' that is sized to receive outlet tube 1016' extending from a second end 1011*b*' of spout body 1011', thereby securing spout body 1011' and outlet tube 1016' within hub 1020'. Hub 1020' may also define one or more internally threaded bores 1028' (FIG. 32) for receiving a plurality of couplers or fasteners, illustratively screws 1080', therein, as discussed further below. Like body portion 1020*a*' of hub 1020', each valve portion 1020*b*', 1020*c*' of hub 1020' also includes an open end 1029*b*', 1029*c*' (FIG. 31). Each of open ends 1029*b*', 1029*c*' has a threaded surface 1021*b*', 1021*c*', respectively (FIG. 31). Open ends 1022', 1024' of body portion 1020*a*' are longitudinally disposed, whereas open ends 1029*b*', 1029*c*' of valve portions 1020*b*', 1020*c*', respectively, are laterally disposed at a substantially 90 degree angle from open ends 1022', 1024'.

Figure 26:
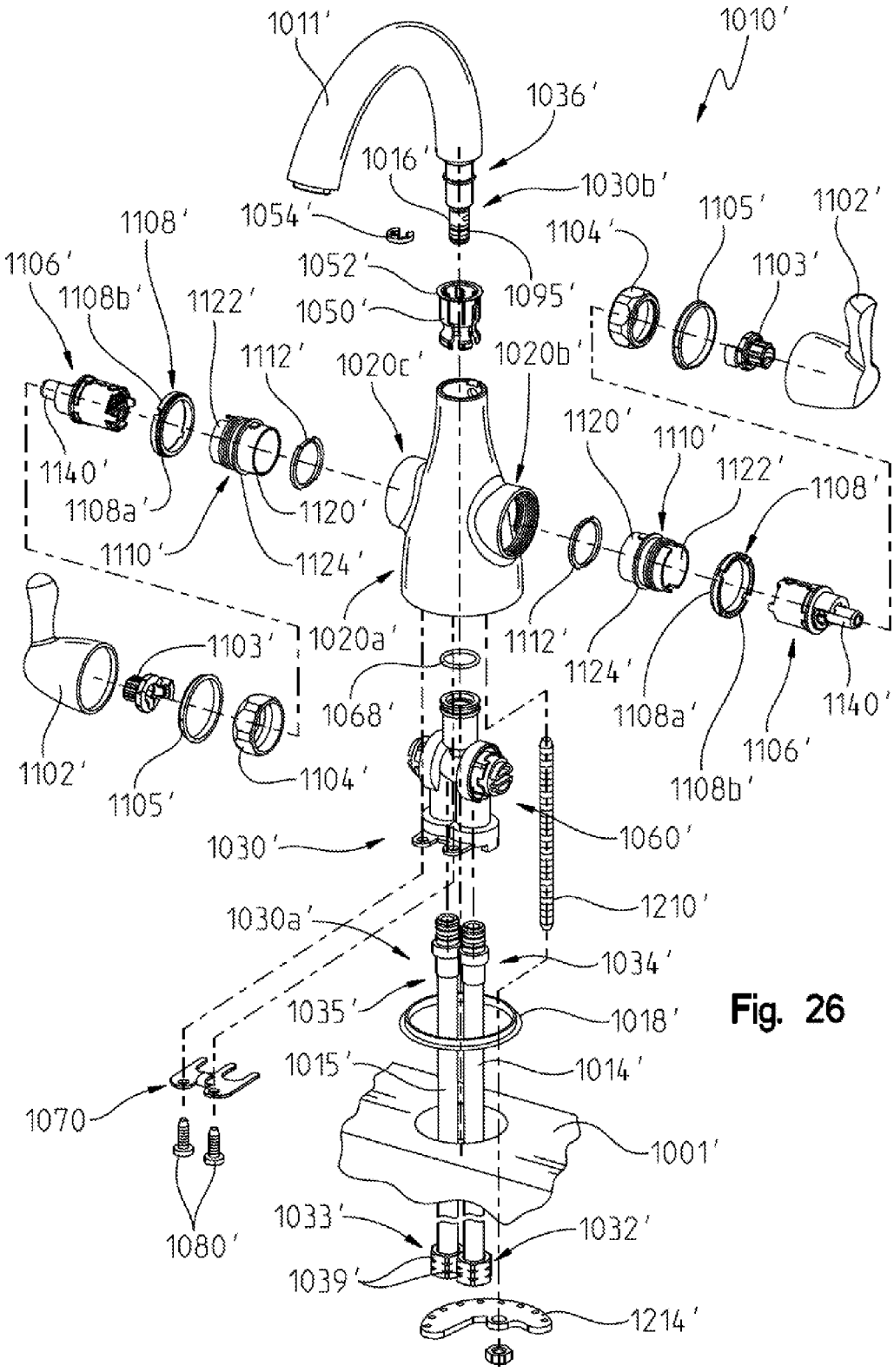
FIG. 26 is an exploded perspective view of the faucet of FIG. 24.
Figure 34:
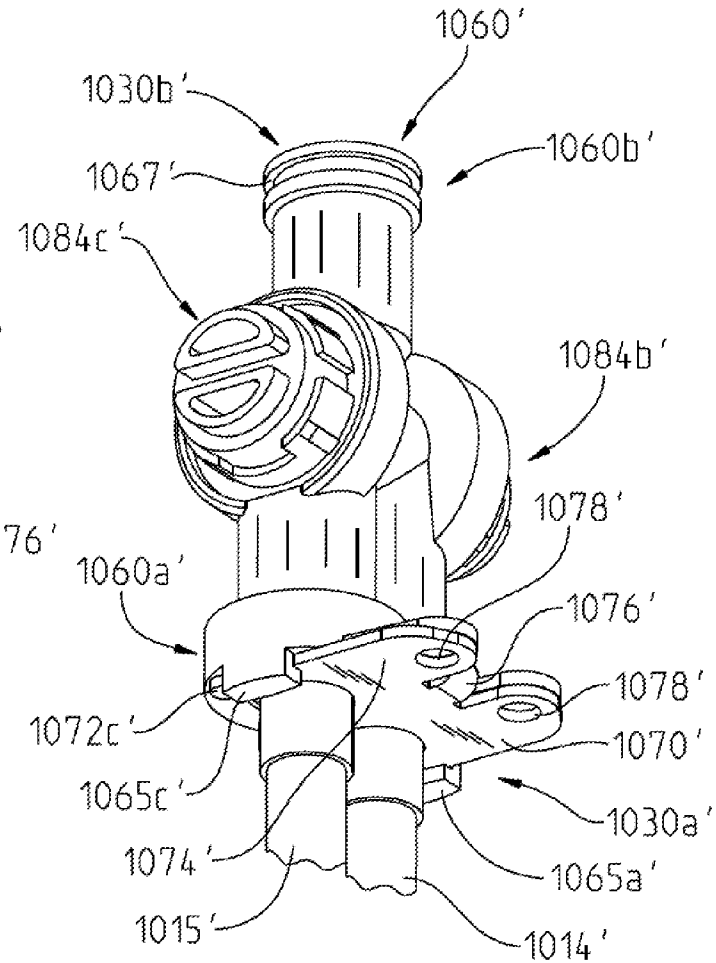
FIG. 34 is a bottom perspective view of the waterway adapter and the retainer clip of FIG. 33, shown with the retainer clip coupled to the waterway adapter.
Figure 33:
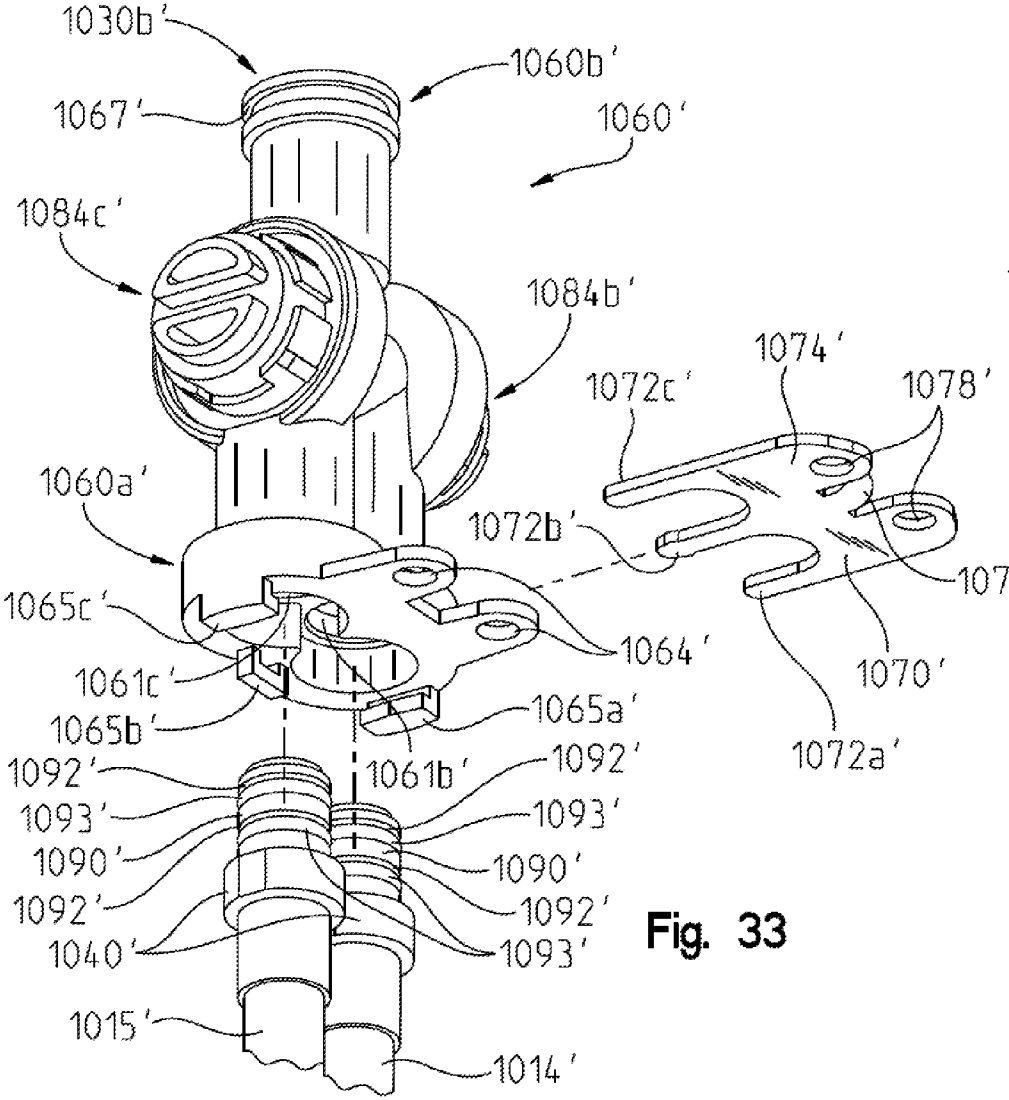
FIG. 33 is a bottom perspective view of the waterway adapter of FIG. 26, including a retainer clip.

With continued reference to FIGS. 26 and 33-34, the illustrative waterway assembly 1030' of faucet 1010' includes an inlet portion 1030*a*', having a cold water inlet tube 1014' and a hot water inlet tube 1015', and an outlet portion 1030*b*' having single outlet tube 1016'. As such, unlike faucet 1010, faucet 1010' is configured for use with more than one water inlet, illustratively hot and cold water inlets, and, therefore, it is necessary to control both the flow rate and the temperature of the water through faucet 1010'. Cold water inlet tube 1014' extends between a first end 1032' and an opposing second end 1034'. Likewise, hot water inlet tube 1015' extends between a first end 1033' and an opposing second end 1035'. First ends 1032', 1033' of respective inlet tubes 1014', 1015' extend freely beneath hub 1020' and sink deck 1001' and may include conventional fluid couplings such as nuts 1039' for fluidly coupling with a cold water supply and a hot water supply, respectively (not shown). Inlet tubes 1014', 1015' extend parallel to each other with generally vertically axis $A_1$' extending therebetween.

As is shown in FIGS. 26-27 and 33-34, each of second ends 1034', 1035' of respective inlet tubes 1014', 1015' may include a shoulder 1040' and a connector, illustratively a nipple 1090', received within hub 1020'. Shoulders 1040' and nipples 1090' are coupled to tubes 1014', 1015' and more particularly, may be overmolded onto inlet tubes 1014', 1015'. As with faucet 1010, there may be alternative means used to couple shoulders 1040' and nipples 1090' with inlet tubes 1014', 1015'. Nipples 1090' may define one or more external, annular grooves 1092' for receiving one or more sealing rings 1093' therein. Illustratively, at least two grooves 1092' are defined on each nipple 1090' and one sealing ring 1093' is retained within each of annular grooves 1092'. The double sealing ring feature of nipples 1090' resists water leakage between waterway adapter 1060' and inlet portion 1030*a*' of waterway assembly 1030'.

Figure 32:
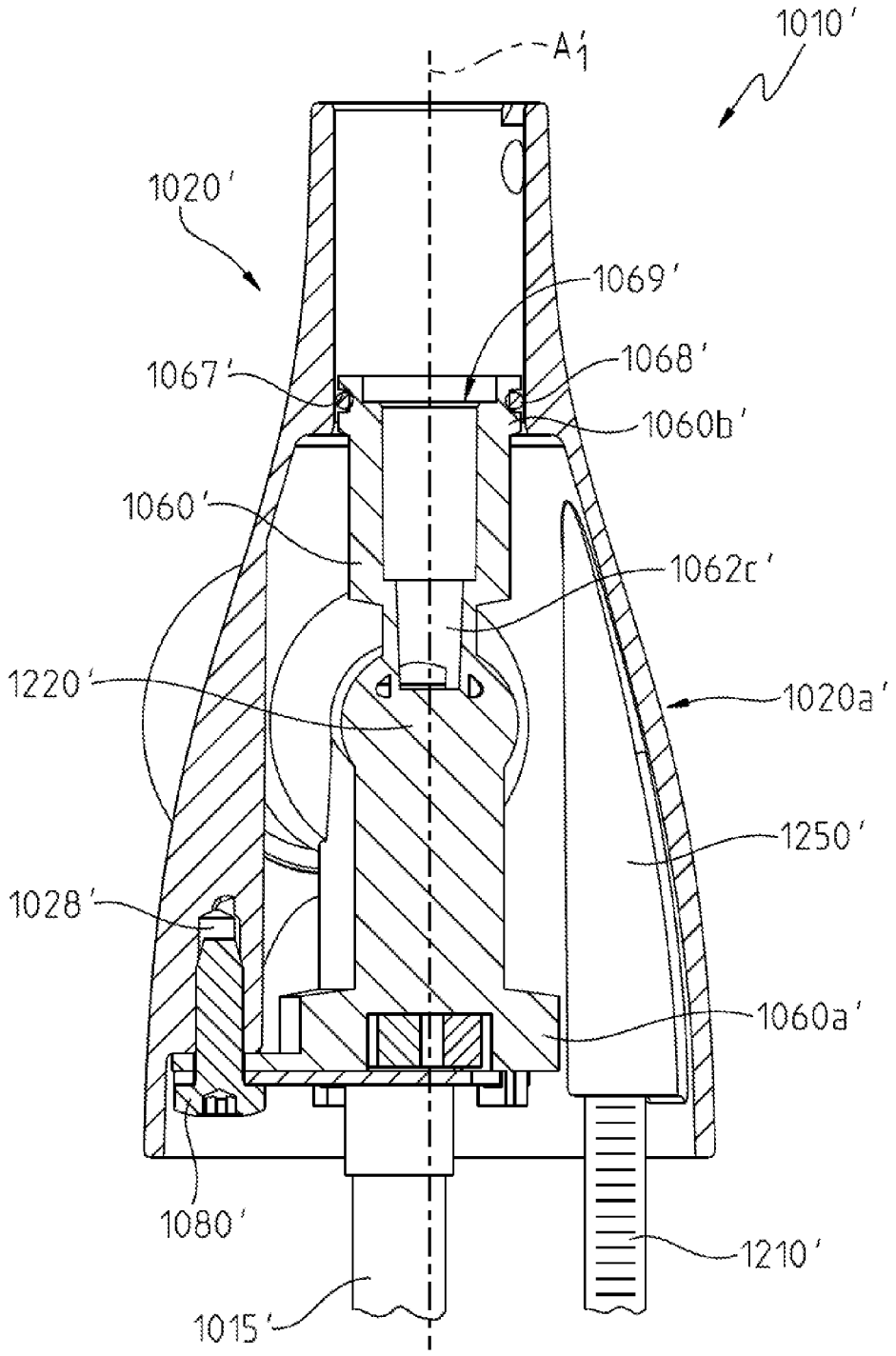
FIG. 32 is a cross-sectional view of the faucet of FIG. 25, taken along line 32-32 of FIG. 25.

The illustrative inlet portion 1030*a*' of waterway assembly 1030' may be mounted to sink deck 1001' and faucet 1010' using a post 1210' received within a shank (not shown) and a mounting plate 1214'. Post 1210', the shank, and mounting plate 1214' provide additional stability to faucet 1010' when in use. Mounting plate 1214' is positioned underneath sink deck 1001' and post 1210' extends through mounting plate 1214' and into a threaded receptacle 1250' hub 1020' (FIG. 32). As with mounting plate 1214', the shank may be positioned underneath sink deck 1001' and adjacent to inlet tubes 1014', 1015'. Mounting plate 1214' has a generally semicircular shape and is configured to engage with inlet tubes 1014', 1015' and the shank. Mounting plate 1214' may be coupled to the shank and sink deck 1001' using conventional fasteners.

Figure 27:
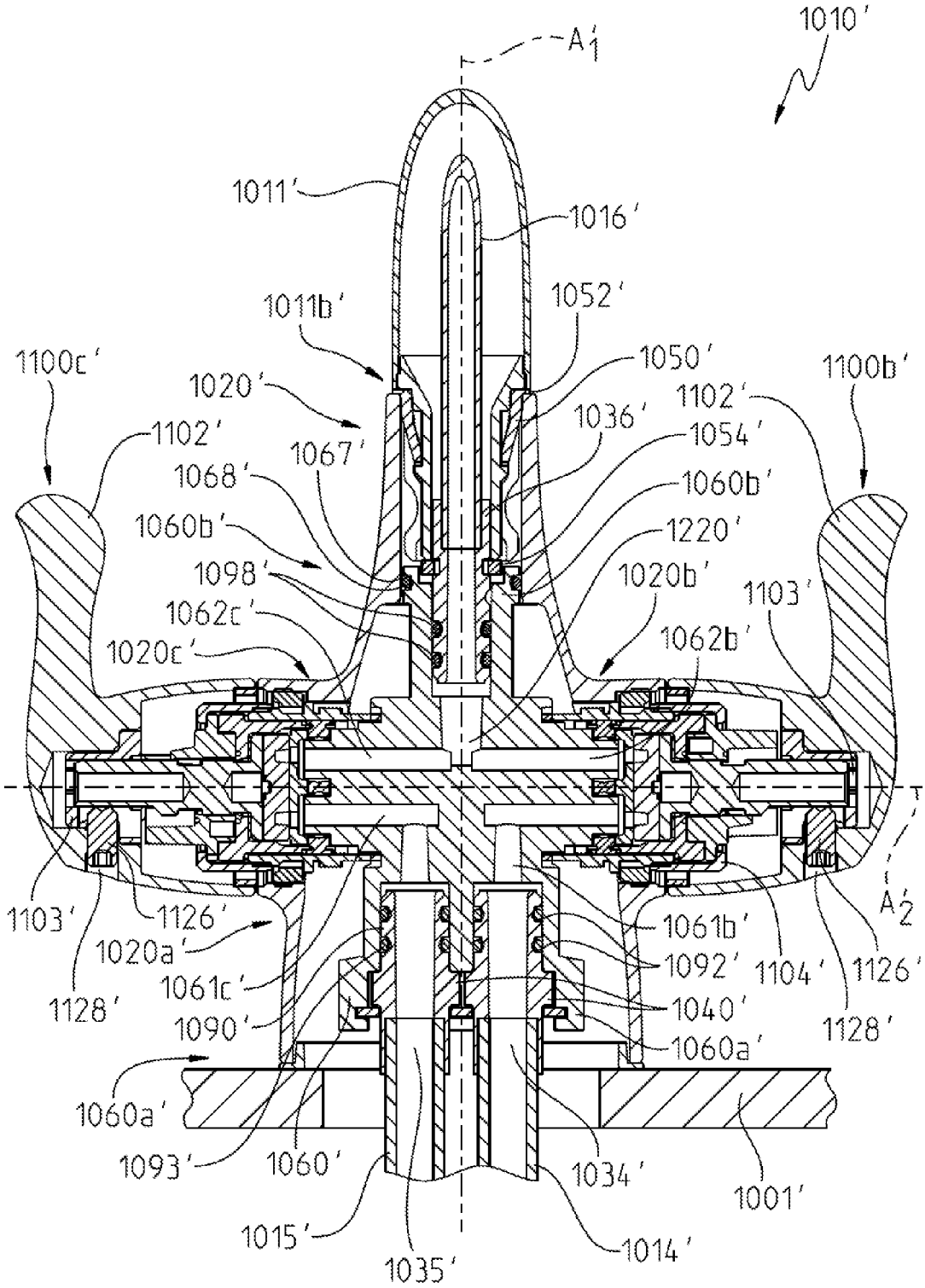
FIG. 27 is a cross-sectional view of the faucet of FIG. 25, taken along line 27-27 of FIG. 25.

Still referring to FIGS. 26-27, outlet tube 1016' of outlet portion 1030*b*' of waterway assembly 1030' is fluidly coupled to waterway adapter 1060' for delivering water from faucet 1010'. Illustratively, outlet portion 1030*b*' is positioned opposite to inlet portion 1030*a*' of waterway assembly 1030', such that outlet portion 1030*b*' is substantially 180° from inlet portion 1030*a*'. However, illustrative outlet tube 1016' is not in axial alignment with inlet tubes 1014', 1015'. Rather, outlet tube 1016' may be aligned with generally vertical axis A1', whereas inlet tubes 1014', 1015' are parallel with vertical axis $A_1$', not co-axial with axis $A_1$'.

Figure 24:
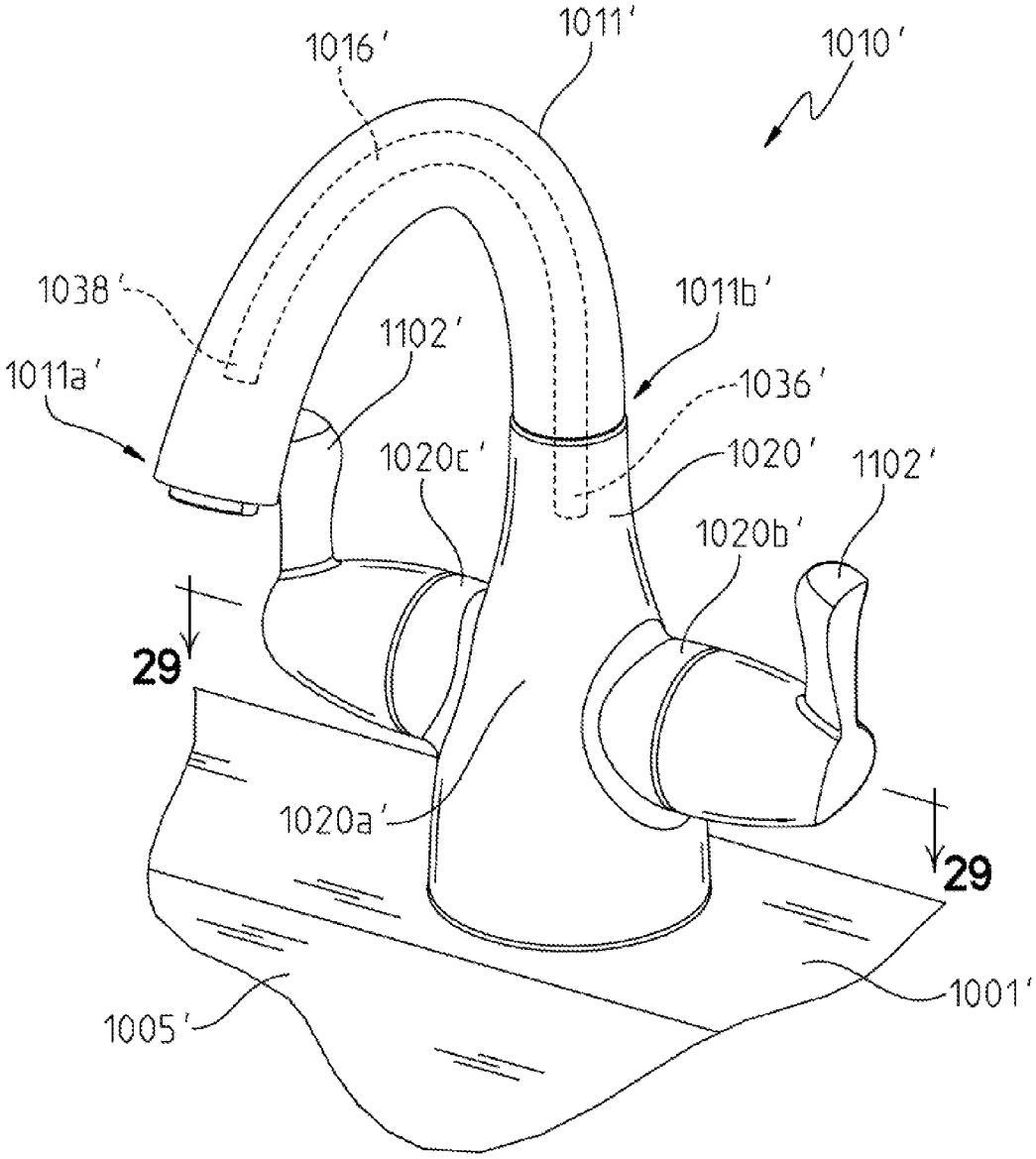
FIG. 24 is a perspective view of an illustrative embodiment two-handle faucet of the present disclosure.
Figure 25:
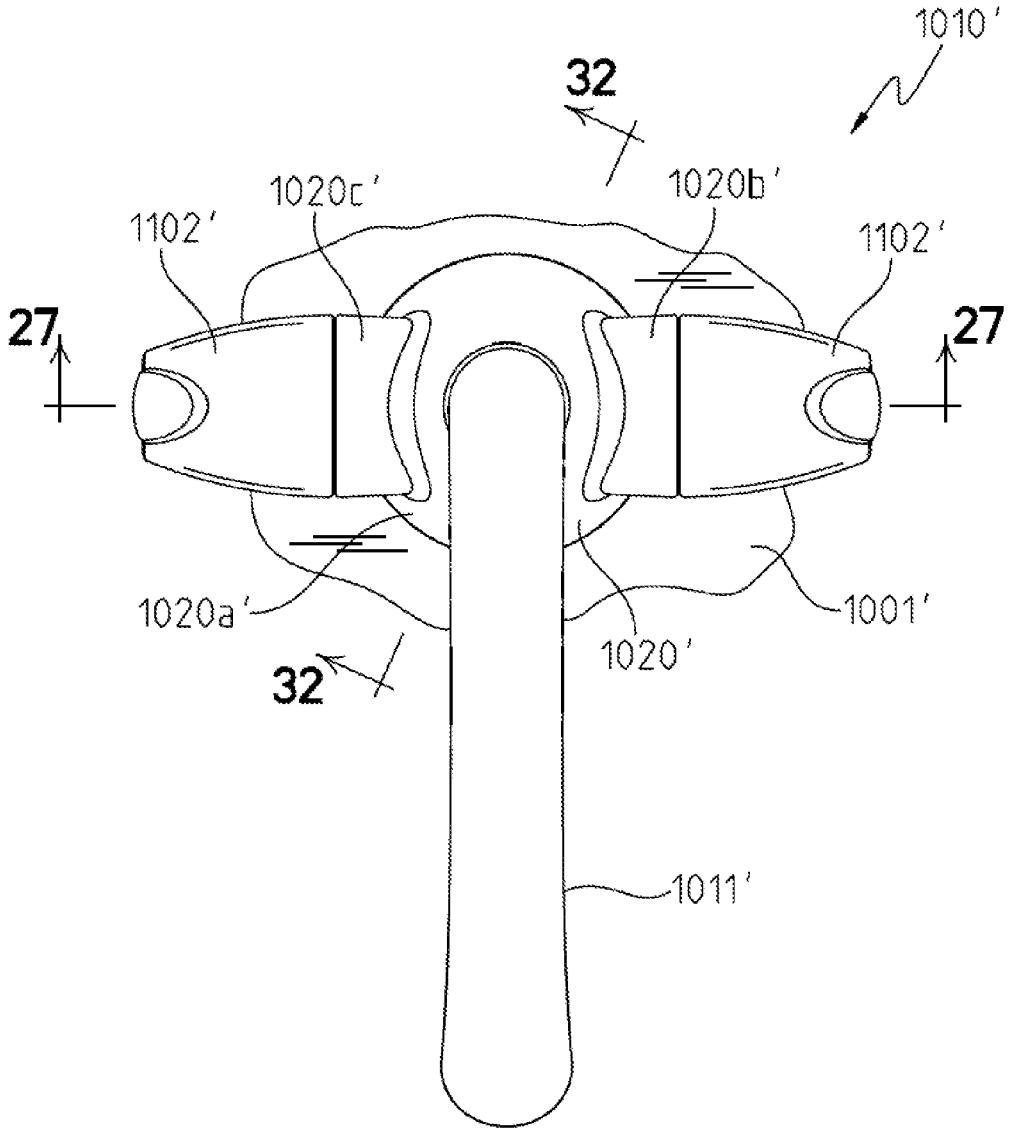
FIG. 25 is a top plan view of the faucet of FIG. 24.

Outlet portion 1030*b*', including outlet tube 1016', of faucet 1010' is illustratively identical to outlet portion 1030*b* and outlet tube 1016 of faucet 1010 and, as such, outlet tube 1016' may include a first end 1036' fluidly coupled to waterway adapter 1060' and an opposing second end 1038' positioned near first end 1011*b*' of spout body 1011' (FIG. 24). As with outlet portion 1030*b* of faucet 1010, outlet tube 1016' of outlet portion 1030*b'* provides a double sealing feature to resist water leakage between waterway adapter 1060' and outlet portion 1030*b'* of waterway assembly 1030'. More particularly, at least two grooves 1096' are defined on a nipple 1095' that may be overmolded onto illustrative outlet tube 1016' and at least one sealing ring 1098' is retained within each of annular grooves 1096'.

Similar to outlet portion 1030, outlet portion 1030*b'* of waterway assembly 1030' may further include spout retainer 1050' and a spout clip 1054' for coupling outlet tube 1016' to waterway adapter 1060'. Spout retainer 1050' may extend within body portion 1020*a'* of hub 1020' from top end 1024' of hub 1020' to a top end 1060*b'* of waterway adapter 1060'. Spout retainer 1050' includes a lip 1052' positioned intermediate spout body 1011' and top end 1024' of hub 1020'. Spout retainer 1050' receives second end 1011*b'* of spout body 1011', a portion of outlet tube 1016', and a portion of nipple 1095'. Spout clip 1054' extends around the outer diameter of outlet tube 1016' and expands beneath spout retainer 1050' to function as a stop that prevents outlet tube 1016' from extending further into waterway adapter 1060' and/or out of waterway adapter 1060'.

With reference to FIGS. 27 and 32-34, the illustrative waterway adapter 1060' of faucet 1010' is configured to be inserted into hub 1020' along the generally vertical axis $A_1'$ and fluidly couples waterway assembly 1030' to valve assemblies 1100*b'*, 1100*c'*. Waterway adapter 1060' defines apertures 1064' generally disposed along opposing sides of a bottom end 1060*a'* of waterway adapter 1060' to receive screws 1080' therethrough for coupling waterway adapter 1060' to waterway assembly 1030' and to hub 1020'. Bottom end 1060*a'* of waterway adapter 1060' defines a cold water inlet channel 1061*b'* and a hot water inlet channel 1061*c'*. Top end 1060*b'* of waterway adapter 1060' is positioned opposite to bottom end 1060*a'* and defines a cold water outlet channel 1062*b'* and a hot water outlet channel 1062*c'*. In the illustrative embodiment, inlet channels 1061*b'*, 1061*c'* and outlet channels 1062*b'*, 1062*c'* are L-shaped or bent at a substantially 90° angle to couple the vertically disposed waterway assembly 1030' to the respective horizontally disposed valve assemblies 1100*b'*, 1100*c'*. More particularly, inlet channel 1061*b'* bends from a substantially vertical disposition to a substantially horizontal disposition extending in the first direction of valve portion 1020*b'*. Inlet channel 1061*c'* also bends from a substantially vertical disposition to a substantially horizontal disposition extending in the opposing second direction of valve portion 1020*c'*. Inlet channel 1061*b'* of waterway adapter 1060' is sized to receive nipple 1090' of cold water inlet tube 1014'. Similarly, inlet channel 1061*c'* is sized to receive nipple 1090' of hot water inlet tube 1015'. Outlet channels 1062*b'*, 1062*c'* of waterway adapter 1060' extend in the substantially horizontal direction of horizontal axis $A_2'$ to meet and converge at a joint 1220' of waterway adapter 1060' to bend in the substantially vertical direction of vertical axis $A_1'$. Joint 1220' facilitates mixing the outlet cold and hot water streams directed toward outlet tube 1016'. Joint 1220' is sized to receive nipple 1095' of outlet tube 1016'.

To resist water leakage and couple waterway adapter 1060' to hub 1020', top end 1060*b'* of waterway adapter 1060' includes at least one annular groove 1067' configured to receive a sealing ring 1068' (FIG. 32). Top end 1060*b'* of waterway adapter 1060' also includes a seat 1069' for receiving spout clip 1054', when clip 1054' is coupled to outlet tube 1016' (FIG. 32). As such, spout clip 1054' may be intermediate top end 1060*b'* of waterway adapter 1060' and second end 1011*b'* of spout body 1011'.

As is shown in FIGS. 26 and 33-34, waterway adapter 1060' may be further coupled to inlet portion 1030*a'* of waterway assembly 1030' with a coupler, illustratively a retainer clip 1070'. Retainer clip 1070' may be positioned below shoulders 1040' such that shoulders 1040' rest atop retainer clip 1070' in order to support inlet tubes 1014', 1015' within waterway adapter 1060'. Retainer clip 1070' includes ears 1074', tab 1076', and fingers 1072', illustratively, a first finger 1072*a'*, a second finger 1072*b'*, and a third finger 1072*c'*. Each of ears 1074' includes at least one aperture 1078', which correspond to apertures 1064' of waterway adapter 1060', to receive screws 1080' therethrough. Fingers 1072*a'*, 1072*b'*, 1072*c'* of retainer clip 1070' are configured to slide along a plurality of tracks 1065', illustratively corresponding tracks 1065*a'*, 1065*b'*, and 1065*c'*, on bottom end 1060*a'* of waterway adapter 1060', whereby tab 1076' couples with a recess 1063' of waterway adapter 1060'. As such, in addition to screws 1080', retainer clip 1070' also is coupled to waterway adapter 1060' when fingers 1072*a'*, 1072*b'*, and 1072*c'* are received within corresponding tracks 1065*a'*, 1065*b'*, and 1065*c'*, and tab 1076' is received along recess 1063'. The visual appearance of retainer clip 1070', specifically tab 1076', helps to prevent misalignment and incorrect positioning of retainer clip 1070' because the structure of tab 1076' suggests that it is configured to cooperate with recess 1063'. Functionally, screws 1080' retain waterway adapter 1060' within hub 1020' but retainer clip 1070' supports inlet tubes 1014', 1015' within waterway adapter 1060'. As such, if screws 1080' fail, hub 1020' may no longer be coupled to sink deck 1001', however, inlet tubes 1014', 1015' remain coupled to waterway adapter 1060', thereby preventing water leakage from faucet 1010'. Alternative embodiments of faucet 1010' may be configured such that screws 1080' do not couple with sink deck 1001' and instead, hub 1020' may be coupled to sink deck 1001' with other fasteners.

Figure 28:
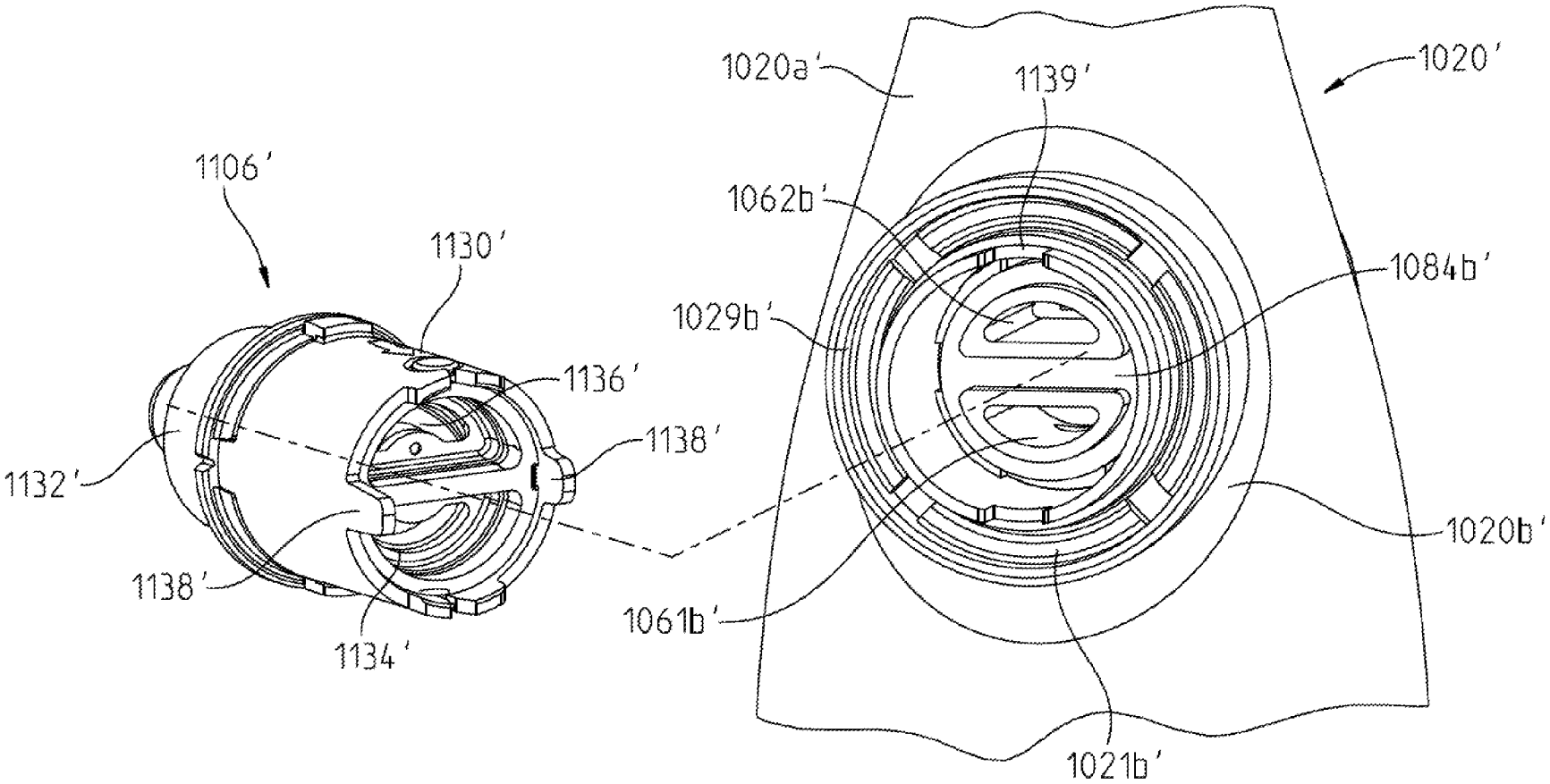
FIG. 28 is an exploded perspective view of a hub and a valve body of the faucet of FIG. 26.
Figure 29:
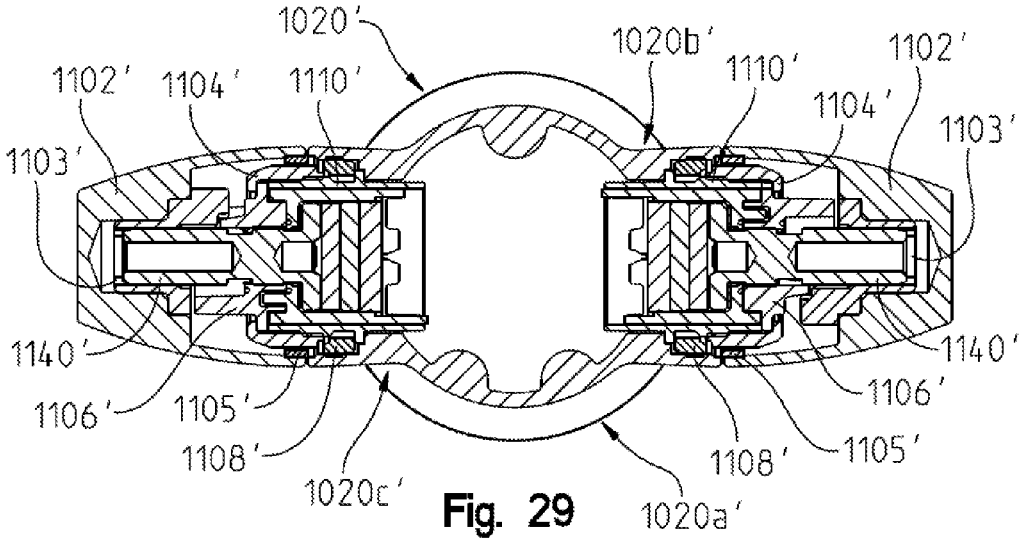
FIG. 29 is a cross-sectional view of the faucet of FIG. 24, taken along line 29-29 of FIG. 24, shown with a waterway adapter removed from the hub and opposing valve assemblies coupled to the hub.
Figure 30:
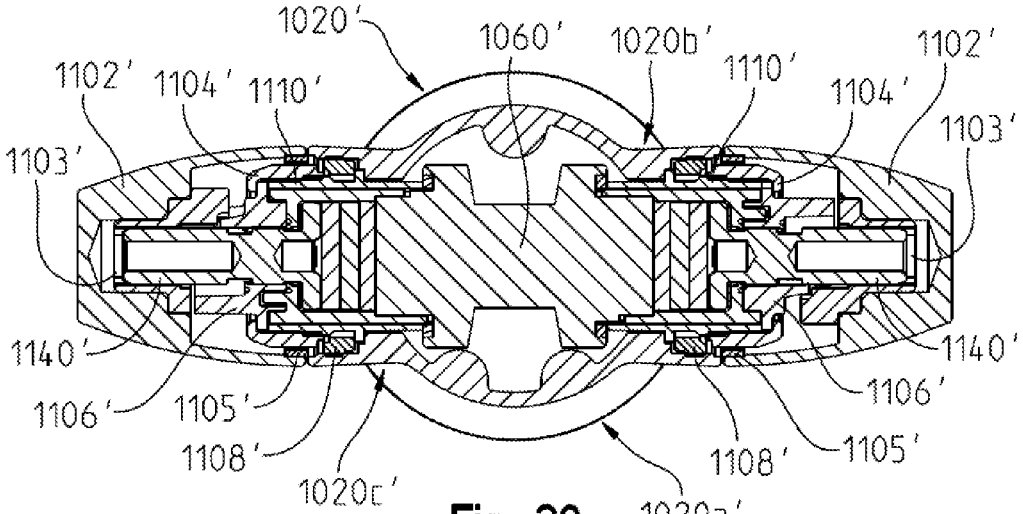
FIG. 30 is a cross-sectional view similar to FIG. 29, shown with the waterway adapter inside the hub and opposing valve assemblies coupled to the hub.

Referring to FIGS. 26-28, the illustrative valve assemblies 1100*b'*, 1100*c'* of faucet 1010' are identical to valve assembly 1100 of faucet 1010. Valve assemblies 1100*b'*, 1100*c'* are positioned along the generally horizontal axis $A_2'$ and, as such, are substantially perpendicular to body portion 1020*a'* of hub 1020'. Each valve assembly 1100*b'*, 1100*c'* includes a handle 1102', a stem enclosure 1103', a bonnet 1104', a sealing member 1105', a valve body 1106', a retaining ring 1108', a sleeve 1110', and a washer 1112'. Valve assembly 1100*b'* is supported by valve portion 1020*b'* of hub 1020' and valve assembly 1100*c'* is supported by valve portion 1020*c'* of hub 1020'. Valve assemblies 1100*b'*, 1100*c'* are removably coupled to waterway adapter 1060' located within body portion 1020*a'* of hub 1020'. Valve assembly 1100*b'* is generally positioned at a right angle to inlet supply tube 1014' and outlet supply tube 1016' when coupled to hub 1020'. Likewise, valve assembly 1100*c'* is generally positioned at a right angle to inlet supply tube 1015' and outlet supply tube 1016'. More particularly, illustrative waterway adapter 1060' includes two substantially identical central portions 1084*b'*, 1084*c'* (FIGS. 33-34) positioned adjacent to open ends 1029*b'*, 1029*c'* (FIG. 31) of valve portions 1020*b'*, 1020*c'* and are configured to couple with valve assemblies 1100*b'*, 1100*c'*, respectively. Valve assemblies 1100*b'*, 1100*c'* may be removed from respective open ends 1029*b'*, 1029*c'* for cleaning or servicing without removing waterway adapter 1060' from body portion 1020*a'* of hub 1020' (FIG. 31). As such, hub 1020' supports waterway adapter 1060' independently of valve assemblies 1100*b'*, 1100*c'*, as is shown in FIGS. 29-31.

Exemplary valve body 1106' is a flow control type configured to adjust the flow rate of water through inlet channels 1061*b'*, 1061*c'* and outlet channels 1062*a'*, 1062*b'*, respectively. As such, the incoming hot and cold water streams are not mixed until each stream reaches joint 1220' of waterway adapter 1060' and flows toward outlet tube 1016'.

As shown in FIGS. 27-28, valve body 1106' of each valve assembly 1100*b*', 1100*c*' includes a lower housing 1130' and an upper housing 1132'. Valve body 1106' also includes a water inlet port 1134' and a water outlet port 1136'. When assembled, water inlet port 1134' is arranged in fluid communication with water inlet channel 1061*b*' of waterway adapter 1060' and outlet port 1136' of valve body 1106' is arranged in fluid communication with outlet channel 1062*b*' of waterway adapter 1060'. Lower housing 1130' of valve body 1106' may seal against central portion 1084*b*' of waterway adapter 1060' to resist leakage between the components (FIGS. 33-34). Likewise, valve body 1106' of valve assembly 1100*c*' seals with central front portion 1084*c*' to fluidly couple water inlet portion 1134' to inlet channel 1061*c*' and water outlet portion 1136' to water outlet channel 1062*c'*.

Referring to FIGS. 27-28 and 33-34, one or more locating elements, illustratively protrusions 1138', extend from lower housing 1130' of valve body 1106' to assist with coupling valve body 1106' to waterway adapter 1060'. More particularly, protrusions 1138' extend from lower housing 1130' of valve body 1106' and mate with one or more corresponding cavities 1139' of each central portion 1084*b*', 1084*c*' of waterway adapter 1060'. Positioning each protrusion 1138' of valve body 1106' within a corresponding cavity 1139' of waterway adapter 1060' facilitates proper orientation of valve body 1106' relative to waterway adapter 1060', and as a result, proper orientation of valve body 1106' relative to waterway assembly 1030'. Therefore, protrusions 1138' of valve body 1106' assist in proper orientation of tubes 1014', 1015' and nipples 1090' of waterway assembly 1030', inlet channels 1061*b*', 1061*c*' of waterway adapter 1060', and ports 1134', 1136' of valve body 1106', respectively. Furthermore, valve body 1106' is properly oriented to fluidly couple outlet channels 1062*b*', 1062*c*' with outlet tube 1016'. Also, the mating of protrusions 1138' and cavities 1139' may improve resistance to torque generated between hub 1020', waterway assembly 1030', waterway adapter 1060', and valve assembly 1100*b'*.

Two-handle faucet 1010' may be assembled by inserting waterway adapter 1060' and inlet portion 1030*a*', including inlet tubes 1014', 1015' of waterway assembly 1030' upwardly into body portion 1020*a*' of hub 1020' through the open end 1022' of hub 1020'. Retainer clip 1070' couples inlet tubes 1014', 1015' to waterway adapter 1060' prior to inserting waterway adapter 1060' into hub 1020'. As shown in FIGS. 26-27, waterway adapter 1060' and inlet portion 1030*a*' of waterway assembly 1030' are both narrower than open end 1022' of hub 1020' so that both components may be inserted upwardly into body portion 1020*a*' of hub 1020'. When assembled, screws 1080' extend through apertures 1078' of retainer clip 1070' and apertures 1064' of waterway adapter 1060', and into internally threaded bores 1028' (FIG. 32) of hub 1020', thereby securing inlet portion 1030*a*' of waterway assembly 1030' and waterway adapter 1060' into body portion 1020*a*' of hub 1020'. Hub 1020' may include at least one internal rail (not shown) to receive waterway adapter 1060' and align central portions 1084*b*', 1084*c*' of waterway adapter 1060' with valve portions 1020*b*', 1020*c*' of hub 1020', respectively. Outlet portion 1030*b*' of waterway assembly 1030' and spout body 1011' may be assembled in the manner described above for outlet portion 1030*b* and spout body 1011 of faucet 1010.

Valve assemblies 1100*b*', 1100*c*' may be assembled in the same manner as valve assembly 1100 of faucet 1010. As such, only valve assembly 1100*b*' will be described hereinafter, however, valve assembly 1100*c*' includes the same features described herein and may also be assembled from the same description. During assembly, washer 1112' of the illustrative valve assembly 1100*b*', having a circular shape, is configured to mate with a central portion 1084*b*' of waterway adapter 1060' by sliding over central portion 1084*b*'. Sleeve 1110' of the illustrative valve assembly 1100*b*' is positioned adjacent to washer 1112' and extends between body portion 1020*a*' and valve portion 1020*b*' of hub 1020' when coupled with waterway adapter 1060'. Sleeve 1110' includes a first end 1120', a second end 1122', and a stop surface 1124' positioned therebetween and protruding radially outward from the perimeter of sleeve 1110'. Illustratively, valve body 1106' is removably coupled to waterway adapter 1060' by fitting sleeve 1110' over valve body 1106' and coupling retaining ring 1108' and bonnet 1104' against sleeve 1110'. Retaining ring 1108' includes an externally threaded end 1108*a*' which engages with threaded surface 1021*b*' of valve portion 1020*b*' of hub 1020' and abuts stop surface 1124' of sleeve 1110' to secure valve assembly 1100*b*' to valve portion 1020*b*'. Bonnet 1104' further slides over second end 1122' of sleeve 1110' and threadedly couples with an internally threaded end 1108*b*' of retaining ring 1108' to force valve body 1106' against waterway adapter 1060', thereby engaging washer 1112' to reduce leakage between waterway adapter 1060' and sleeve 1110'. To further reduce leakage from valve portion 1020*b*' of hub 1020', sealing member 1105' is received over bonnet 1104'. Illustratively, a portion of sealing member 1105' is positioned between valve portion 1020*b*' and handle 1102'. Stem enclosure 1103' is provided intermediate upper housing 1132' of valve body 1106' and handle 1102' to receive a stem 1140', coupled to valve body 1106', and transmits motion from handle 1102' to stem 1140', and therefore, to valve body 1106'. Handle 1102' may be received over stem enclosure 1103' and bonnet 1104' and further secured to valve assembly 1100*b*' using conventional couplers or fasteners, illustratively, a screw 1126' received within an aperture 1128' of handle 1102'.

Each valve assembly 1100*b*', 1100*c*' may be operated by adjusting or moving handle 1102' relative to hub 1020'. Handle 1102' may be moveable about at least generally horizontal axis $A_2$'. Adjusting handle 1102' actuates stem 1140' of valve body 1106' and stem enclosure 1103', both of which transmit movement of handle 1102' to valve body 1106'. Therefore, by adjusting handle 1102', a user is able to selectively vary the flow rate of water supplied to outlet port 1136' of valve body 1106'. With respect to valve assembly 1100*b*', waterway assembly 1030' is in fluid communication with valve body 1106' via waterway adapter 1060', and therefore, adjusting handle 1102' allows a user to selectively vary the flow rate of water supplied to outlet channel 1062*b*' of waterway adapter 1060' and outlet tube 1016' from water inlet tube 1014' and inlet channel 1061*b*' of waterway adapter 1060'. Because hot water valve assembly 1100*c*' may be simultaneously operated in the same way as valve body 1100*b*', the temperature of the water supplied to outlet tube 1016' is also adjusted. As with valve assembly 1100, the illustrative valve assemblies 1100*b*', 1100*c*' are of a movable disc variety.

In use, cold water flows from the cold water supply (not shown) to valve assembly 1100*b*' of faucet 1010'. Similarly, hot water flows from the hot water supply (not shown) to valve assembly 1100*c*' of faucet 1010'. The cold water stream flows vertically along generally vertical axis $A_1$' from the water supply via water inlet tube 1014' and nipple 1090' of waterway assembly 1030' and bends at a right angle after entering water inlet channel 1061*b*' of waterway adapter 1060'. The cold water then follows generally horizontal axis $A_2$' to enter water inlet port 1134' of valve assembly 1100*b*'. The cold water stream then flows from outlet port 1136' of valve assembly 1100*b*' through outlet channel 1062*b*' of waterway adapter 1060' and then will travel through a generally right angle bend at joint 1220'. Per the user's selection, either simultaneously with the cold water or in instead of the cold water, hot water may independently flow vertically along generally vertical axis $A_1$' from the water supply to enter water inlet tube 1015' and nipple 1090' and bend at a right angle after entering water inlet channel 1061*c*'. The hot water then follows generally horizontal axis $A_2$' to enter water inlet port 1134' of valve assembly 1100*c*'. The hot water stream then flows from outlet portion 1136' of valve assembly 1100*c*' through outlet channel 1062*c*' of waterway adapter 1060' and then will travel through a generally right angle bend at joint 1220'. At joint 1220', the hot and cold water streams mix to form a single outlet stream which vertically travels along generally vertical axis $A_1$' through outlet nipple 1095' and outlet tube 1016' of waterway assembly 1030'.

Although the invention has been described in detail with reference to certain preferred embodiments, variations and modifications exist within the spirit and scope of the invention as described and defined in the following claims.

The invention claimed is:

1. A fluid delivery device including:

a spout;

a hub coupled to the spout and including a generally hollow body portion having a longitudinally disposed first open end and a valve portion having a laterally disposed second open end, the body portion of the hub configured to rest atop a surface, the second open end of the valve portion disposed substantially perpendicular to the first open end of the body portion, the body portion of the hub including a vertically-extending wall generally opposite the valve portion and spaced apart from the valve portion, the vertically-extending wall extending continuously from proximate the surface to proximate the spout;

a valve assembly removably coupled to the valve portion of the hub and in fluid communication with the spout;

a waterway assembly in fluid communication with the valve assembly, the waterway assembly including:

a single inlet supply tube;

a waterway adapter removably coupled to the body portion of the hub, the waterway adapter being configured to contact a portion of the vertically-extending wall of the hub to retain the waterway adapter within the hub, and the waterway adapter perpendicularly coupling the single inlet supply tube to the valve assembly; and a single outlet supply tube in fluid communication with the waterway adapter and the spout.

2. The fluid delivery device of claim 1, wherein the waterway adapter is constructed of a polymeric material.

3. The fluid delivery device of claim 1, wherein the valve assembly is sized for insertion into the second open end of the valve portion.

4. The fluid delivery device of claim 1, wherein the hub supports the waterway adapter independently of the valve assembly such that the waterway adapter is supported by the hub when the valve assembly is removed from the hub.

5. The fluid delivery device of claim 1, further comprising a clip that couples the single inlet supply tube to the waterway adapter.

6. The fluid delivery device of claim 5, wherein the clip includes a first member and a second member, the first and second members are configured to engage with a first track and a second track of the waterway adapter.

7. The fluid delivery device of claim 6, wherein the first member of the clip is sized to engage with the first track of the waterway adapter, and the second member of the clip is sized to engage with the second track of the waterway adapter, the size of the first member being larger than the size of the second track and preventing the first member from engaging with the second track.

8. The fluid delivery device of claim 1, wherein the waterway adapter defines an inlet channel and an outlet channel, the inlet channel of the waterway adapter fluidly coupled to the single inlet supply tube, and the outlet channel fluidly coupled to the single outlet supply tube.

9. The fluid delivery device of claim 8, wherein the waterway assembly is arranged vertically and the valve assembly is arranged horizontally, and wherein the inlet channel and the outlet channel of the waterway adapter are L-shaped to fluidly couple the vertically arranged waterway assembly to the horizontally arranged valve assembly.

10. The fluid delivery device of claim 1, further comprising a handle, the handle being removably coupled to the valve assembly and the hub, the handle being moveable relative to the hub and configured to adjust fluid flow through the fluid delivery device.

11. A fluid delivery device including:

a hub including a body portion disposed along a generally vertical axis and a valve portion disposed along a generally horizontal axis;

a valve assembly positionable in the valve portion of the hub along the generally horizontal axis; and a waterway assembly including:

at least one inlet supply tube;

an outlet tube; and a waterway adapter laterally spaced from the valve assembly and configured to be fluidly coupled to the valve assembly at an interface, the waterway adapter being positionable in the body portion of the hub along the generally vertical axis, the waterway adapter having a bottom end and a top end opposite the bottom end, the bottom end of the waterway adapter defining an inlet for receiving the at least one inlet supply tube, the inlet is configured to direct the inlet supply tube in a downward direction, and the top end of the waterway adapter defining an outlet for receiving the outlet tube, the outlet is configured to direct the outlet tube in an upward direction.

12. The fluid delivery device of claim 11, wherein the waterway adapter is constructed of a polymeric material.

13. The fluid delivery device of claim 11, wherein the hub includes a vertical rail that projects into a hollow interior of the hub to guide insertion of the waterway adapter into the body portion of the hub along the generally vertical axis.

14. The fluid delivery device of claim 13, wherein the valve assembly forces the waterway adapter against the vertical rail to resist removal of the waterway adapter from the body portion of the hub along the generally vertical axis.

15. The fluid delivery device of claim 13, wherein the vertical rail is located rearward of the waterway assembly and rearward of the valve assembly.

16. The fluid delivery device of claim 11, further including at least one threaded coupler supporting the waterway adapter within the hub.

17. The fluid delivery device of claim 11, further comprising a handle coupled to the valve assembly and moveable about at least the generally horizontal axis.

18. A fluid delivery device including:

a hub;

a valve assembly removably coupled to the hub and including an inlet port and an outlet port;

a waterway adapter coupled within the hub, the waterway adapter being laterally spaced from the valve assembly and fluidly coupled to the valve assembly at an interface, the waterway adapter defining at least one inlet channel in fluid communication with at least one inlet supply tube, the waterway adapter further defining at least one outlet channel in fluid communication with at least one outlet supply tube, the at least one inlet channel of the waterway adapter in fluid communication with the inlet port of the valve assembly, and the at least one outlet channel of the waterway adapter in fluid communication with the outlet port of the valve assembly; and at least one coupler removably coupled to the waterway adapter and the at least one inlet supply tube, the at least one coupler supporting the at least one inlet supply tube within the waterway adapter in the hub and being positioned beneath the waterway adapter.

19. The fluid delivery device of claim 18, wherein the valve assembly is positioned generally perpendicular to the waterway adapter.

20. The fluid delivery device of claim 18, further comprising a single inlet supply tube in fluid communication with the inlet channel of the waterway adapter, and a single outlet supply tube in fluid communication with the outlet channel of the waterway adapter, the outlet supply tube being disposed generally 180-degrees away from the inlet supply tube.

21. The fluid delivery device of claim 20, wherein the at least one coupler includes a first finger and a second finger for engaging with the inlet supply tube, the first finger and the second finger being configured for receipt along a bottom end of the waterway adapter.

22. The fluid delivery device of claim 18, wherein the at least one coupler is configured to support the waterway adapter within the hub when the valve assembly is coupled to the hub and when the valve assembly is removed from the hub.

23. The fluid delivery device of claim 1, wherein the vertically-extending wall of the hub has a protrusion, and a portion of the waterway adapter engages the protrusion to retain the waterway adapter within the hub.

24. A fluid delivery device including:

a hub including a generally hollow body portion having a longitudinally disposed first open end and a valve portion having a laterally disposed second open end, the body portion of the hub configured to rest atop a surface, the second open end of the valve portion disposed substantially perpendicular to the first open end of the body portion;

a spout coupled to the hub;

a valve assembly removably coupled to the valve portion of the hub and in fluid communication with the spout;

a waterway assembly in fluid communication with the valve assembly, the waterway assembly including:

a single inlet supply tube;

a waterway adapter removably coupled to the body portion of the hub, the waterway adapter perpendicularly coupling the single inlet supply tube to the valve assembly;

a single outlet supply tube in fluid communication with the waterway adapter and the spout; and a clip that couples the single inlet supply tube to the waterway adapter, wherein the clip includes a first member and a second member, the first and second members are configured to engage with a first track and a second track of the waterway adapter.

* * * * *